United States Patent [19]

Oishi et al.

[11] 4,015,989

[45] Apr. 5, 1977

[54] COLOR LIGHT-SENSITIVE MATERIAL WITH SPONTANEOUSLY DEVELOPABLE SILVER HALIDE EMULSION CONTAINING DESENSITIZING DYE

[75] Inventors: Yasushi Oishi; Masanao Hinata, both of Minami-ashigara, Japan

[73] Assignee: Fuji Photo Film Co., Ltd., Minami-ashigara, Japan

[22] Filed: Jan. 30, 1975

[21] Appl. No.: 545,671

[30] Foreign Application Priority Data

Jan. 30, 1974 Japan ..... 49-12453

[52] U.S. Cl. ..... 96/77; 96/3; 96/29 D; 96/55; 96/68; 96/74; 96/76 R; 96/101

[51] Int. Cl.[2] ..... G03C 1/40; G03C 1/76; G03C 1/48; G03C 7/00

[58] Field of Search ..... 96/3, 29 D, 76 R, 55, 96/67, 68, 74, 77, 101

[56] References Cited

UNITED STATES PATENTS

| | | | |
|---|---|---|---|
| 3,227,551 | 1/1966 | Barr et al. | 96/3 |
| 3,297,445 | 1/1967 | Duennebier et al. | 96/95 |
| 3,364,022 | 1/1968 | Barr | 96/3 |
| 3,379,529 | 4/1968 | Porter et al. | 96/66 |
| 3,443,940 | 5/1969 | Bloom et al. | 96/3 |
| 3,736,136 | 5/1973 | Danhauser et al. | 96/3 |
| 3,816,121 | 6/1974 | Shiba et al. | 96/101 |
| R28,208 | 10/1974 | Sato et al. | 96/101 |

*Primary Examiner*—J. Travis Brown
*Assistant Examiner*—Richard L. Schilling
*Attorney, Agent, or Firm*—Sughrue, Rothwell, Mion, Zinn & Macpeak

[57] ABSTRACT

A color photographic light-sensitive material which comprises a support having thereon at least one emulsion layer unit comprising;

A. a hydrophilic colloid layer containing spontaneously developable silver halide grains which are associated with a coupler capable of reacting with an oxidation product of an aromatic primary amino color developing agent to provide a dye and which are rendered substantially light-insensitive with a desensitizer, and B. an adjacent negative type light-sensitive silver halide emulsion layer associated with a compound capable of reacting with an oxidation product of an aromatic primary amino color developer to release a diffusible development inhibitor.

26 Claims, 3 Drawing Figures

COLOR LIGHT-SENSITIVE MATERIAL WITH SPONTANEOUSLY DEVELOPABLE SILVER HALIDE EMULSION CONTAINING DESENSITIZING DYE

BACKGROUND OF THE INVENTION

1. Field of the Invention

The present invention relates to a color photographic light-sensitive material and, more particularly, to a light-sensitive material capable of directly providing a reversal color image through one color development.

2. Description of the Prior Art

In the general use of color photography, color photographic images are desired to be obtained as fast as possible after photographing through as simple a processing as possible to produce a positive image visually corresponding to the photographed object.

In ordinary practice, exposed silver halide photographic light-sensitive materials are subjected to a series of development-processing steps involving one development processing to provide images which are in a negative relation to the original. Therefore, in order to obtain positive images to the original, the negative images obtained by a series of development-processing steps must be subjected to an additional series of processing steps involving one development processing after exposure again for printing.

A reversal development-processing system is another process to obtain a positive image from an original. This processing usually involves first development, washing, bleaching, washing, a cleaning bath, a washing bath, an exposure or fogging bath, and the like. In particular, a color reversal development-processing system involves first black-and-white development, a stopping bath, a hardening bath, washing, an exposure or fogging bath, washing, a color-developing bath, washing, a bleaching bath, washing, fixing, washing, a stabilizing bath, and the like. In general, these steps are extremely complicated and time-consuming. Therefore, it is often advantageous to record or duplicate a positive image directly as a positive image.

The so-called "autopositive-type emulsion" which is a silver halide emulsion capable of directly providing a developed silver image with a positive image distribution through one development processing is known. However, many emulsions of this type do not provide good positive images through development with an aromatic primary amino color developing agent in the presence of a dye-forming coupler. Some suggestions are set forth in U.S. Pat. Nos. 3,227,552, 3,330,655, 3,352,672, British Pat. No. 1,085,581, etc., as to autopositive emulsions capable of providing positive images under the conditions of color development. However, these processes have the defects in that sufficient sensitivity to take pictures under ordinary illumination is difficult to obtain and the minimum density of reversal images is not satisfactorily low.

Of the processes to obtain a positive image through one color development using an ordinary negative-type light-sensitive silver halide emulsion, there is a process of using an emulsion layer unit comprising a layer containing a spontaneously developable silver salt and an adjacent negative-type light-sensitive silver halide emulsion layer containing a compound capable of reacting with an oxidation product of an aromatic primary amino color developing agent, as disclosed in U.S. Pat. Nos. 3,227,551, 3,227,554, 3,364,022 and German Pat. OLS 2,032,711. This process has the advantage that a highly sensitive light-sensitive material whose spectrally sensitized region can easily be expanded is provided. However, this process has the defect that the minimum density of the reversal image is not satisfactorily low, mainly due to the residual light sensitivity of the spontaneously developable silver salt, resulting in providing photographic images having stained highlight areas. This defect is particularly serious with a blue-sensitive emulsion layer unit.

SUMMARY OF THE INVENTION

An object of the present invention is to provide a highly sensitive color photographic light-sensitive material capable of providing a positive image through one color development using an aromatic primary amino color developing agent.

Another object of the present invention is to provide a color light-sensitive material which can provide a positive image through one color development and which has a sensitivity over a wide wavelength region.

A further object of the present invention is to provide a color light-sensitive material capable of providing a positive image having a low minimum density through one color development.

Still a further object of the present invention is to provide a color light-sensitive material capable of providing a diffusible dye having a positive image distribution through one color development, and to provide a diffusion transfer color photographic film unit containing this color light-sensitive material.

These and other objects of the present invention will become apparent from the following detailed descriptions and Examples.

It has now been found that the above-described objects of the present invention are attained by acting a desensitizing dye on spontaneously developable silver halide grains contained in an emulsion unit to render the silver halide grains substantially light-insensitive, the emulsion unit being provided on a support and comprising:

A. a hydrophilic colloid layer containing spontaneously developable silver halide grains which are associated with a coupler capable of reacting with an oxidation product of an aromatic primary amino color developing agent to provide a dye and which are rendered substantially light-insensitive with a desensitizer, and B. an adjacent negative-type light-sensitive silver halide emulsion layer associated with a compound capable of reacting with an oxidation product of an aromatic primary amino color developing agent to release a diffusible development inhibitor.

DETAILED DESCRIPTION OF THE INVENTION

Figure 1:
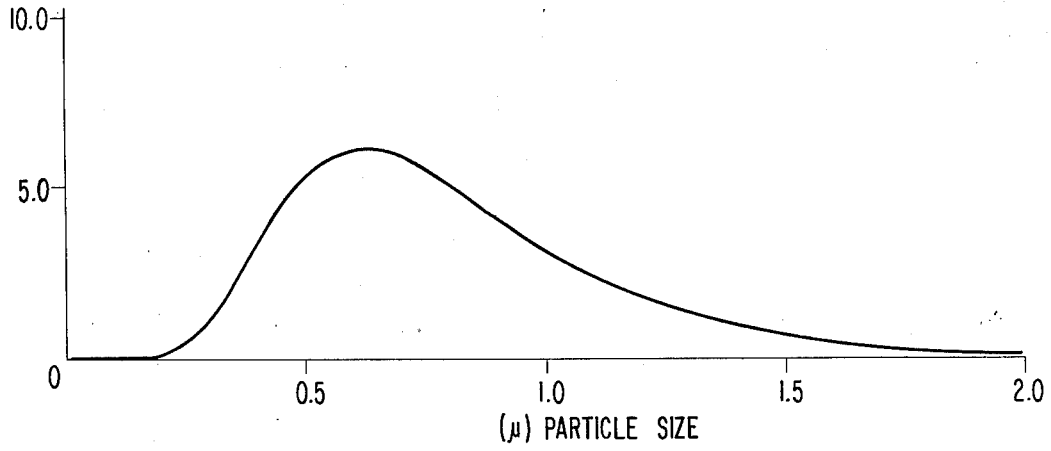
FIG. 1 is a graph showing the particle size distribution of a spontaneously developable silver bromoiodide dispersion used in the present invention.

The desensitizer to be used in the present invention can be those compounds which are well-known in photographic chemistry, such as azines (as described in P. Glafkides; *Chimie Photographique*, 2nd. Ed., pp.737–745, Paul Montel (1957) (e.g., safranines, quinoxalines, etc.), nitro compounds, azo dyes, anthraquinones, triphenylmethanes, carbocyanines, styryls, anils, azocyanines, etc.

The desensitizing dyes usable in the present invention are substances which do not oxidize existing for development nuclei and which can trap free electrons of silver halide grains. Also, they can be defined as compounds which possess a minimum empty electron energy level lower than the electron conduction band of silver halide grains. This electron energy band is known to correspond linearly to the cathode polarographic half-wave potential. The desensitizing agents usable in the present invention are compounds having a cathode polarographic half-wave potential, preferably, more positive than about −1.0 volt (more preferably, those which possess an anodic polarographic potential more positive than about 0.7 volt). This means that these desensitizers possess sufficient electron affinity to trap free electrons generated in silver halide by light and to sufficiently control the formation of a latent image. This half-wave potential value is measured in an acetonitrile solution containing tetra-n-propylammonium perchlorate as a supporting electrolyte at 25° C using a dropping mercury electrode and a saturated calomel electrode as a reference electrode.

Desensitizers to be used in the present invention are compounds which are so strongly absorbed on silver halide that they do not substantially migrate in a light-sensitive material from the layer (to which the desensitizers are added) to other layers. This property is necessary for not spoiling the light sensitivity of the negative-type light-sensitive silver halide layer in the light-sensitive material. The strong adsorption of the desensitizer must be exhibited in the presence of photographically effective ingredients (many of which are anionic) such as couplers, surface active agents for dispersion, coating aids, binders, etc. For this purpose, the desensitizer desirably possesses at least one acidic group such as a sulfo group, a carboxy group, a phosphoric acid group, etc. The adsorption property required of the desensitizer and the diffusion-resistance resulting from the adsorption property can be assured through an experiment for confirming that the light sensitivity of the negative-type silver halide emulsion layer in a light-sensitive material having the structure of the present invention is not reduced substantially or through an experiment for confirming that the free density obtained by measuring the adsorption isotherm of the desensitizer to the surface of silver halide grain is sufficiently low. Desensitizers useful for the present invention can be selected through such routine experiments as described above.

Specific examples of desensitizers to be used with advantage in the present invention are as follows which, however, are not intended to limit the present invention at all:

General Formula

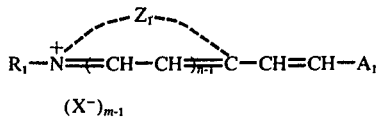

(I)

wherein $Z_1$ represents the atoms necessary for forming a heterocyclic ring (selected from 5-, 6- or 7-membered heterocyclic ring nuclei usually used for cyanine dyes), $R_1$ represents a saturated aliphatic group (e.g., an unsubstituted alkyl group, e.g., having 1 to 4 carbon atoms such as methyl group, an ethyl group or a propyl group; and a substituted alkyl group, e,g., having 1 to 8 carbon atoms and 1 to 4 carbon atoms in the alkyl moiety thereof such as a hydroxyalkyl group (e.g., a 2-hydroxyethyl group, a 3-hydroxypropyl group), an alkyl group having a carboxy group (e.g., a carboxyalkyl group such as a 2-carboxyethyl group, a 3-carboxypropyl group or a 4-carboxybutyl group), a carboxyalkoxy-substituted alkyl group (e.g., a 2-(2-carboxyethoxy)ethyl group), an alkyl group having a sulfo group (e.g., a sulfoalkyl group such as a 2-sulfoethyl, 3-sulfopropyl or 3-sulfobutyl group), a sulfo-alkoxy-substituted alkyl group (e.g., a 2-(3-sulfopropoxy)ethyl group, a 3-sulfopropoxyethoxyethyl group), a sulfohydroxysubstituted alkyl group (e.g., a 2-hydroxy-3-sulfopropyl group), $A_1$ represents a phenyl group having at least one nitro group, a naphthyl group, or a heterocyclic group such as an indole nucleus and pyrazole nucleus and the like, *m* and *n* each represents an integer of 1 or 2 and, when the compound forms a betaine structure, *m*=1, and represents an anionic group commonly employed for cyanine dyes, and $R_1$, $Z_1$ or $A_1$ contains at least one sulfo group, carboxy group or phosphoric acid group;

General Formula

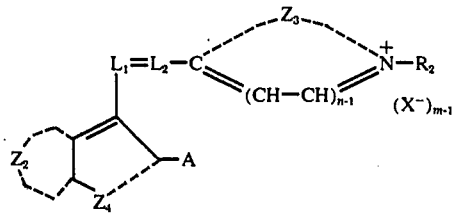

(II)

wherein $Z_2$ represents the atoms necessary for forming a cycloheptatriene ring which may be substituted with an alkyl group having 1 to 4 carbon atoms such as a methyl group, an isopropyl group, etc., a halogen atom such as a chlorine atom, a bromine atom, etc., an alkoxy group such as a methoxy group, etc., an aryl group such as a phenyl group, a nitrophenyl group, etc., $Z_3$ represents the atoms necessary for forming a heterocyclic ring, in particular, a 5- or 6-membered heterocyclic nucleus commonly used for cyanine dyes, $Z_4$ represents an oxygen atom, —NH—or —CH=, A represents a hydrogen atom, an oxygen atom (=0) or a halogen atom such as a chlorine atom, a bromine atom or an iodine atom, $L_1$ and $L_2$ each represents a methine group (including a substituted methine group such as a methine group substituted with a methyl group, a phenyl group, a cyano group and the like), $R_2$ represents a saturated aliphatic group having at least one of a sulfo group, a carboxy group or a phosphoric acid group (e.g., an alkyl group having a carboxy group (e.g., a carboxyalkyl group such as a 2-carboxyethyl group, a 3-carboxypropyl group or a 4-carboxybutyl group), a carboxy-alkoxy-substituted alkyl group (e.g., a 2-(2-carboxyethoxy)ethyl group), an alkyl group having a sulfo group (e.g., a sulfoalkyl group such as a 2-sulfoethyl, 3-sulfopropyl or 3-sulfobutyl group), a sulfoalkoxy-substituted alkyl group (e.g., a 2-(3-sulfopropoxy)ethyl group, a 3-sulfopropoxyethoxyethyl group), a sulfo-hydroxy-substituted alkyl group (e.g., a 2-hydroxy-3-sulfopropyl group), a sulfosubstituted aralkyl group (e.g., p-sulfophenethyl group), an alkyl group having a phospho group (e.g., γ-phosphopropyl group) and the like) or an unsaturated aliphatic group (e.g., an allyl group), and X, *n* and *m* are the same as defined in general formula (I);

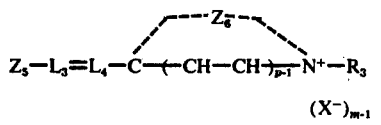

(III)

wherein $Z_5$ represents an indole nucleus, a carbazole nucleus or a phenothiazine nucleus (which may be a substituted with any substituent atom or group as long as the dye of the general formula (III) has desensitizing capabilities), $Z_6$ is the same as $Z_3$ defined in general formula (II), $R_3$ represents a saturated or unsaturated aliphatic group (e.g., an alkyl group, an alkenyl group, a substituted alkyl group, etc., such as methyl group, an ethyl group, a propyl group, a carboxyethyl group, a sulfobutyl group, a phosphopropyl group, an allyl group, a p-sulfobenzyl group and the like), an unsaturated aliphatic group or an aryl group (where $R_3$ represents an alkyl group, it is preferably a lower alkyl group whose alkyl moiety has 1 to 6 carbon atoms), $Z_5$, $Z_6$ or $R_3$ contains at least one sulfo group, carboxy group or phosphoric acid group, $L_3$ and $L_4$ each represents a methine group (including a substituted methine group such as a methine group substituted with a methyl group, a phenyl group, a cyano group and the like), *p* represents an integer of 1 or 2, and $X^-$ and *m* are the same as defined in general formula (I);

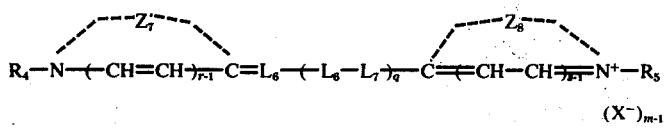

(IV)

wherein $Z_7$ and $Z_8$ each represents the atoms necessary for forming a 5- or 6-membered heterocyclic nucleus, at least one of $Z_7$ and $Z_8$ representing the atoms necessary for forming a 5- or 6-membered heterocyclic nucleus having an electron acceptive or desensitizing action (in particular, indole, nitro-substituted indolenine, imidazoquinoquizaline, nitro-substituted benzothiazole, pyrrolopyrido, nitro-substituted benzoxazole, etc.), $R_4$ and $R_5$ are the same as defined with respect to $R_1$ in general formula (I), at least one of $R_4$ and $R_5$ containing a sulfo group, a carboxy group or a phosphoric acid group, *q* represents an integer of 1, 2 or 3, *r* and *s* each represents an integer of 1 to 2, $L_6$ and $L_7$ each represents a methine group (including a substituted methine group such as a methine group substituted with a methyl group, a phenyl group, a cyano group and the like), and $X^-$ and *m* are the same as defined in general formula (I).

Illustrative heterocyclic nuclei commonly used for cyanine dyes are, e.g., oxazole, benzoxazole, napthoxazole, thiazole, benzothiazole, napthothiazole, selenazole, benzoselenazole, naphthoselenazole, indolenine, indole, imidazole, benzimidazole, imidazoquinoquizaline, pyrrolopyrido nuclei, etc.

Suitable anionic groups commonly used for cyanine dyes are, e.g., halide ion, perchlorate ion, thiocyanate ion, methylsulfate ion, ethylsulfate ion, sulfonate ion, p-toluenesulfonate ion, etc.

These desensitizing dyes of the general formulas (I) to (IV) are described in, for example, U.S. Pat. No. 3,816,121 and U.S. reissue Pat. No. 28,208.

Specific examples of these compounds of the general formulas (I) to (IV) are given below.

(S-1)

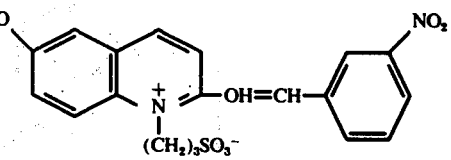

(S-2)

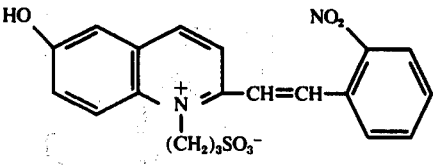

-continued
(S-3)
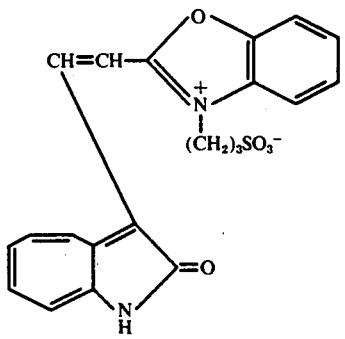
(S-4)
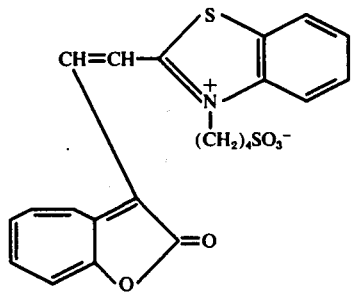
(S-5)
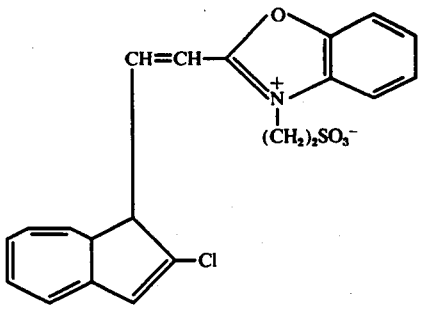
(S-6)
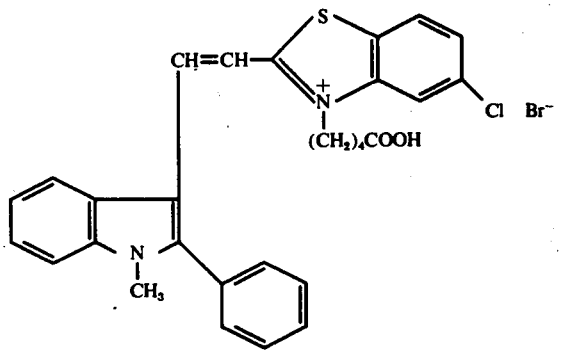
(S-7)
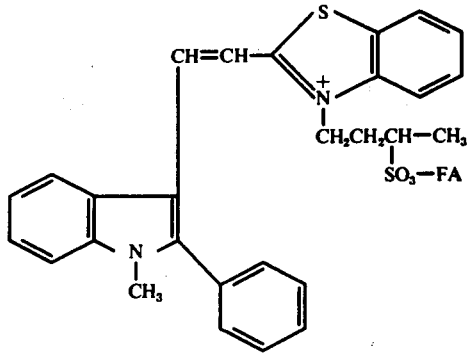

-continued
(S-8)
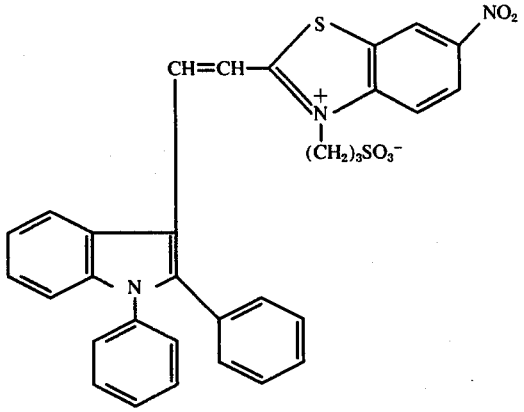
(S-9)
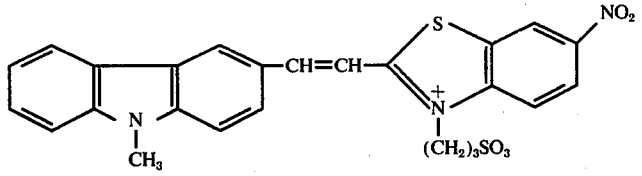
(S-10)
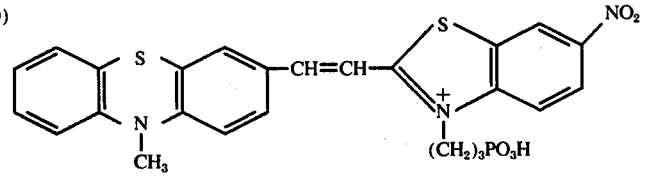
(S-11)
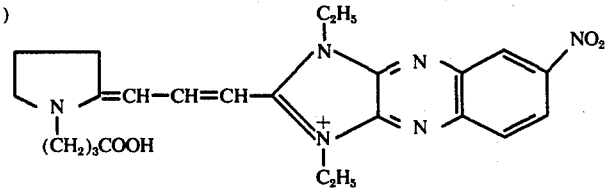
(S-12)
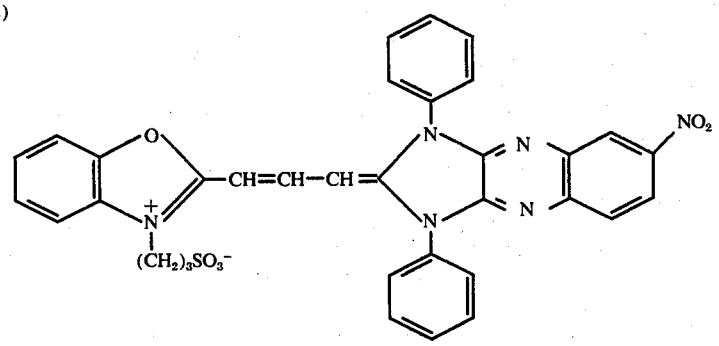
(S-13)
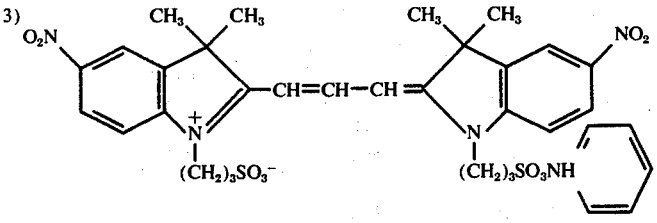
(S-14)
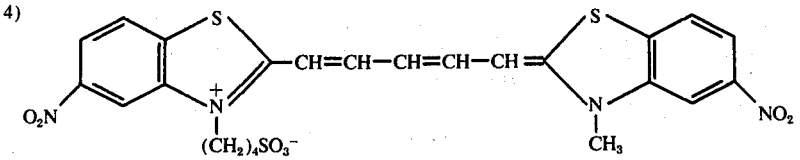

-continued (S-15)

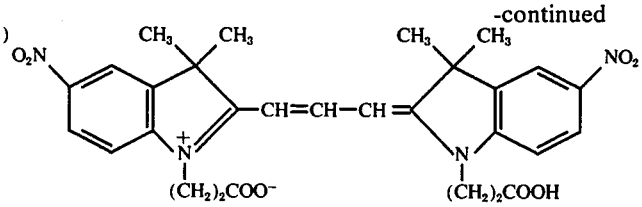

(S-16)

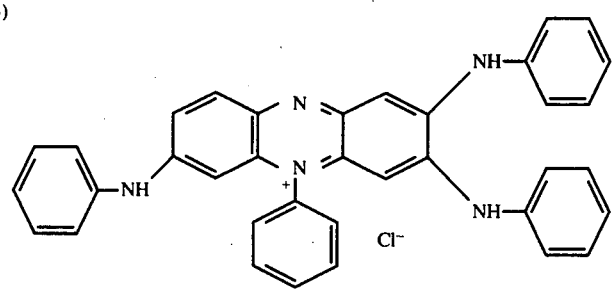

(Induline 3B, CI 50400)

(S-17)

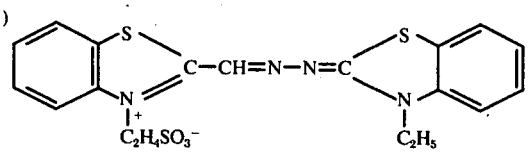

In addition, electron acceptors described in S. Dänne; Z. WISS. Phot. Vol. 59, p.113 t sequ. (1966) and U.S. Pat. No. 3,501,307 can also be used as a desensitizer of the present invention. Furthermore, desensitizers described in Japanese Pat. application Nos. 127575/72, 126862/72 and 36376/73 can be used.

The spontaneously developable silver halide grains to be used in the present invention are silver halide grains which can be developed by processing in a conventional developer without exposure and include silver bromide, silver chloride, silver chlorobromide, silver chloroiodide, silver bromoiodide or silver chlorobromoiodide. Comparatively large-sized grains are useful, because it is advantageous for the specific surface area of the grains to be limited in order to effectively control the development of spontaneously developable silver halide grains with a limited amount of a development inhibitor to be released from an adjacent light-sensitive emulsion layer. In particular, a dispersion of silver halide grains containin about 0.5 to 10 mol% iodide grains whose mean grain size is not less than about 0.5 $\mu$ and not more than about 2 $\mu$ is advantageous. More particularly, a dispersion containing fine grains of a size not greater than 0.3 $\mu$ in a low amount (not more than about 30% of the total) is useful. The silver halide grains can possess a cubic, octahedral or mixed form crystal habit and, in appearance, they can be in a cubic, planar or spherical form. Silver halide grains can be prepared in the same manner as for a light-sensitive emulsion by mixing a water-soluble silver salt solution with a water-soluble halide solution in the presence of a protective colloid and if desired, heat-processing in the presence of a solvent for silver halide to allow the crystals to grow.

Silver halide grains can be rendered spontaneously developable through various processes. For example, physical means such as irradiation with light, X-ray, $\gamma$-ray, $\beta$-ray or like radiation, irradiation with ultrasonic waves, deformation of silver halide grains by mechanical action, and the like are useful. In particular, formation of nuclei capable of functioning as a developing (fog-developing) nucleus on the surface of silver halide grains through chemical means is useful. As such a nucleus-forming agent, there are illustrated those materials which react with silver halide to form a silver nucleus, a gold nucleus, a sulfide nucleus, a selenide nucleus, etc. such as a reducing agent, a mono- to tri-valent gold complex salt, active sulfur or a selenide. Illustrative specific examples of particularly useful nucleus-forming substances are hydrazine compounds and precursors thereof such as hydrazine, phenylhydrazine, amylsuccinylhydrazine, hydrazobenzene, p-phenylenedisemicarbazide, sulfosuccinylhydrazide, etc.; amines such as triethylenetetramine, tetraethylenepentamine, polyethyleneimine, etc.; ethylenebispyridium salt; hydroxytetronimides or hydroxypyronimides such as 5-phenyl-3-hydroxytetronimide, 5,6-diphenyl-3,4,5-trihydroxy-5,6-dihydropyronimide, etc.; stannous salts such as stannous chloride; reducing saccharides contained in gelatin; sulfites; gold complex salts such as monovalent gold chloro complex salt, gold bromocomplex salt, thiosulfate complex salt, thiocyanate complex salt, thiourea complex salt, etc.; thiosulfates or tetrathionic acid salts; active sulfur organic compounds such as arylthiourea, trimethylthiourea, etc.; the natural sulfur sensitizers contained in gelatin; and the like. These nucleus-forming compounds are acted, individually or in combination, on silver halide to thereby form fog development nuclei which enable spontaneous development without the action of light to occur. The reaction is advantageously conducted under the conditions of a pH from about 4 to about 10, a pAg from about 5 to about 11, and a temperature from about 30° C to about 80° C, although these conditions vary greatly depending upon the property of silver halide and property of the nucleus-forming compound. Individual reaction conditions can be selected with ease by those skilled in the art. In general, with silver halide grains to be processed with these nucleus-forming agents, the light sensitivity increases and reaches maximum as the amount of nucleus-forming agent increases and the processing time increases and, when the amount and/or time is further increased, the light sensitivity gradually decreases while the spontaneous development ability (fog density) gradually increases. As the reaction is further continued, the spontaneous development ability continues to increase to a final value. Spontaneously developable silver halide grains useful for the present invention are those which have been processed according to the above-described nucleus-forming reaction to such degree that they have experienced maximum light sensitivity. In particular, if this maximum light sensitivity is assumed to have a final value of 1, those silver halide grains which have been processed to such a degree that the spontaneously developable ability thereof falls within the range of from about 0.2 to about 0.8 based on the final value of 1, are useful. The thus processed spontaneously developable silver halide grains exhibit a sufficiently long induction period to permit, upon development, an development inhibitor from an adjacent layer to effectively function, with the developing nuclei on the silver halide grains markedly losing their catalytic action due to the action of the development inhibitor. Thus, such silver halide grains tend to provide a reversal image corresponding to an image of an adjacent light-sensitive layer.

However, silver halide emulsions having been subjected to the nucleus-forming processing to the above-described degree still generally possess a considerable residual negative sensitivity. This residual negative sensitivity functions to cancel out the action of a reversal image formation from an adjacent light-sensitive layer, leading to the disadvantageous result that minimum density of the reversal image is increased. In the present invention, the desensitizing dye can provide a surprisingly good reversal property by removing the residual negative sensitivity without exhibiting substantial influences on the spontaneous developability of silver halide grains.

The dye-forming couplers to be used in the present invention in combination with the spontaneously developable silver halide grains are diffusion-resistant compounds capable of reacting with an oxidation product of an aromatic primary amino color developing agent to provide diffusible or non-diffusible dyes. Couplers capable of providing a diffusible dye are suited for diffusion transfer color photography wherein the dyes produced are fixed in an image-receiving layer, while couplers capable of providing non-diffusible dyes are suited for ordinary color photography wherein dye images formed by color development are utilized after removing silver deposited and residual silver halide in the photographic layers.

Diffusion-resistant couplers to be used in the present invention which provide non-diffusible dyes are compounds which contain both a coupler nucleus residue capable of reacting with an oxidation product of an aromatic primary amino color developing agent to form a dye structure and a hydrophobic residue having 8 or more carbon atoms. The coupler nucleus residue used can be those described in C. E. K. Mees & T. H. James; *The Theory of the Photographic Process*, 3rd Ed. pp. 383–394, MacMillan, (1966), and W. Pelz; *Farbkuppler, Agfa Mitteilungen (Leverkusen)*, III, 111–175 Springer (1961) as well as a phenol residue, an aniline residue and an open-chain or cyclic active methylene group-containing residue. The hydrophobic residue functions to reduce the solubility of the coupler in an aqueous medium or reduce the diffusibility thereof in photographic layers due to the action of increased cohesive force between the coupler molecules or between the coupler molecule and an oily substance to thereby increase intermolecular association, or the like. Useful hydrophobic residues are a straight or branched chain alkyl group such as an n-octyl group, a 2-ethylhexyl group, a t-octyl group- a n-nonyl group, a triisopropyl group, a decyl group, 1,1-dimethylhexadecyl group, a stearyl group, etc.; a cycloalkyl group such as a 2,4-di-n-amylcyclohexyl group, etc.; an alkenyl group such as an oleyl group, etc.; an aryl group such as a terphenyl group, etc.; a haloalkyl group such as a 8,9-dichloroheptadecyl group, a perfluorooctyl group, etc.; an alkoxyalkyl or alkylthioalkyl group such as a 3-n-dodecyloxypropyl group, a 2-n-dodecylthiopropyl group, etc.; an alkylaryl group such as a 4-t-amylphenyl group, a p-n-octylphenyl group, a 2,4-di-t-butylphenyl group, a 2,4-di-t-amylphenyl group, a 3-n-pentadecylphenyl group, etc.; an alkoxyaryl group such as a 3-n-hexyloxyphenyl group, a 3-n-dodecyloxyphenyl group, 2-n-dodecyloxyphenyl group, etc.; and the like. These hydrophobic residues are connected to the coupler nucleus group either directly or through a divalent linking group such as an alkylene group, an arylene group, an oxyalkyl group (-O-alkylene group) (e.g., an oxymethylene group, an α-oxyethyl group, an α-oxypropyl group, an ω-oxybutyl group, etc.), an amido group, a carbamyl group, a sulfonamido group, a sulfamyl group, an ureido group, an imido group (e.g.,

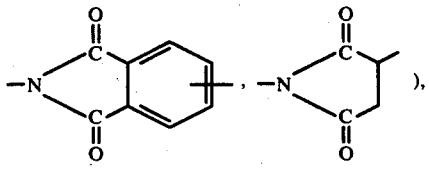

a carbonyl group, a carbonyloxy group, an oxycarbonyl group, a sulfonyl group, a sulfonyloxy group, an oxysulfonyl group, or the like. With coupler nuclei having no water-solubilizing group such as a sulfo group or a carboxy group, the hydrophobic group can be contained in the substituent positioned at the coupling site which is to be eliminated by the oxidation product of an aromatic primary amino color developing agent on coupling. The diffusion-resistant couplers to be used in the present invention can contain a water-solubilizing group such as a sulfo group, a carboxy group, a sulfonamido group, etc. In the so-called Fischer type couplers having such water-solubilizing groups, the hydrophobic residues preferably contain 12 to 32 carbon atoms, whereas in the so-called oleophilic protect-type couplers having no such hydrophilic groups, the hydrophobic residues preferably contain 8 to 32 carbon atoms.

Specific examples of ballasting groups comprising the hydrophobic group and the linking group particularly suitable for the diffusion-resistant couplers to be used in the present invention are: a fatty acid amido group such as a n-lauroylamido group, a stearoylamido group, an oleoylamido group, etc.; a carbamyl group substituted with an alkyl or alkenyl group, such as an N-laurylcarbamyl group, an N-methyl-N-stearylcarbamyl group, an oleylcarbamyl group, etc.; substituted aliphatic amido groups described in U.S. Pat. Nos. 3,337,344 and 3,418,129; an α-(2,4-di-t-amylphenoxy)acetamido group illustrated in U.S. Pat. No. 2,600,788; an α-(2,4-di-sec-amylphenoxy)acetamido group described in British Pat. No. 1,149,514; an α- or γ-(3-pentadecylphenoxy)butyramido group described in U.S. Pat. No. 2.908,573; aliphatic amido groups substituted with an alkylaryloxy group, such as an α-dimethyl-α-(3-pentadecylphenoxy)acetamido group; aliphatic amido groups substituted with a water-solubilizing group, such as a 1-octadecenyl-succinmonoamido group, an α-sulfo-stearolyamido group, etc.; alkoxy groups such as an octadecyloxy group, etc.; ester groups such as a cetyloxycarbonyl group illustrated in U.S. Pat. Nos. 3,409,439 and 3,551,155; a sulfamyl group such as an N,N-dioctylsulfamyl group, etc.; and the like.

An α-acylacetamido residue and, particularly preferably, an α-acylacetanilido residue are useful as the nucleus of the coupler to be used in the present invention providing a yellow dye. These residues are connected to the above-described ballasting groups containing the hydrophobic residue in the acylamido (anilido) group and the eliminatable residue is at the coupling position. The above-described coupler nuclei can be additionally substituted with substituents such as a halogen atom, an alkyl group, an alkoxy group, an aryloxy group, a carboxy group, a sulfo group, an alkoxycarbonyl group, a sulfamyl group, an acylamido group, a sulfonamido group, an amino group, a nitro group, a cyano group, etc.

The ballasted couplers to be advantageously used in the present invention providing non-diffusible yellow dyes can be selected from among those conventionally known couplers described in the aforesaid reviews by Mees and James, supra, and Pelz, supra. α-Benzoylacetamide couplers having a water-solubilizing group, described in BIOS 1901, FIAT 943 and Japanese Pat. Publication No. 6030/65; olephilic α-benzoylacetamide couplers described in U.S. Pat. Nos. 2,407,210, 2,875,057, 3,409,439, 3,551,155, 3,551,156, 3,649,276, 3,685,995, British Pat. No. 1,286,411; α-pivaloylacetamide couplers described in U.S. Pat. No. 3,265,506, and the like are particularly useful for the practice of the present invention. Furthermore, one hydrogen atom located at the α-position of these α-acylacetamido groups can be substituted with a residue which can be eliminated as an anion, such as an arylthio group, a heterocyclic thio group, a halogen atom such as a fluorine atom described in U.S. Pat. No. 3,277,155, a thiocyano group described in U.S. Pat. No. 3,253,924, an acyloxy group described in U.S. Pat. No. 3,447,928, an aryloxy group described in U.S. Pat. No. 3,408,194, a sulfonyloxy group described in U.S. Pat. No. 3,415,652, a diacylamino group described in German Pat. OLS No. 2,213,461, etc.

Typical preferred yellow couplers include the following couplers.

Y-1. α-(4-Stearoylaminobenzoyl)aceto-2,5-dicarboxyanilide

Y-2. α-[4-(α-Octadecenylsuccin-monoamido)benzoyl]aceto-2-methoxy-5-carboxyanilide Y-3. α-(4-Octadecyloxybenzoyl)aceto-2-methoxy-5-sulfoanilide potassium salt Y-4. α-{3-[α-(2,4-Di-t-amylphenoxy)butyramido]-benzoyl}-aceto-2-methoxyanilide Y-5. α-(4-Methoxybenzoyl)aceto-2-chloro-5-[α-(2,4,-di-t-amylphenoxy)butyramido]anilide Y-6. α-Benzoylaceto-2-chloro-5-dodecyloxycarbonylanilide Y-7. α-(2-Methylbenzoyl)aceto-2-chloro-5-tetradecyloxy-carbonylanilide Y-8. α-(2-Methylbenzoyl)aceto-2-chloro-5-[N,N-bis-(2-ethylhexyl)sulfamyl]anilide Y-9. α-(4-Methoxybenzoyl)-α-(5,5-dimethyl-3-hydantoinyl)-aceto-2-chloro-5-[α-(2,4-di-t-amylphenoxy)butyramido]-anilide Y-10. α-Pivaloyl-α-(4-carboxyphenoxy)aceto-2-chloro-5-[α-(3-pentadecylphenoxy)-butyramido]anilide As the nuclei for the couplers to be used in the present invention providing a magenta dye, a 5-pyrazolone residue, a pyrazolobenzimidazole residue, an indazolone residue and a 1-H-pyrazolo[3,2-C]-s-triazole residue are useful. In particular, a 1-aryl-5-pyrazolone is useful. In the present invention, 5-pyrazolone compounds having in the 1-position a phenyl group unsubstituted or substituted with a halogen atom, an alkyl group, an alkoxy group, an aryloxy group, an acylamino group, a sulfonamido group, a carbamoyl group, a sulfamyl group, an alkoxycarbonyl group, a cyano group, a nitro group, a carboxy group, a sulfo group, etc., and 5-pyrazolone compounds substituted in the 3-position with an alkyl group, an alkoxy group, an aryloxy group, an amino group (e.g., an anilino group, etc.), an acuylamino group, a sulfonamido group, an ureido group a carbamyl group, an alkoxycarbonyl group, etc. can be used with great advantages. Also, the corresponding acylated products of these 5-pyrazole compounds can be similarly used. The ballasting group containing a hydrophobic residue is advantageously contained in the substituent in the 1- or 3-position of the 5-pyrazolone compounds.

The ballasted couplers to be advantageously used in the present invention providing non-diffusible magenta dyes can be selected from among those described in the aforesaid reviews by Mees and James supra, and Pelz supra, or other literature. 1-Phenyl-3-alkyl-5-pyrazolone couplers having water-solubilizing groups, described in BIOS 1901, FIAT 943; 3-alkoxy-5-pyrazolone couplers described in U.S. Pat. No. 2,439,098; 3-acylamino-5-pyrazolone couplers described in U.S. Pat. Nos. 2,600,788, and 3,062,653, etc.; 3-amino-5-pyrazolone couplers described in British Pat. No. 956,261 and German Pat. OLS No. 2,015,867; 3-arylureido-5-pyrazolone couplers described in U.S. Pat. No. 3,558,319; and the like are particularly useful for the practice of the present invention. Furthermore, one hydrogen atom of the active methylene group at the 4-position of the 5-pyrazolones can be substituted with a residue which can be eliminated with an oxidation product of the aromatic primary amine color developing agent, such as an arylazo group; a heterocyclic azo group; an arylthio group; a heterocyclic thio group; a thiocyano group as described in U.S. Pat. No. 3,253,924; an aryloxy group described in U.S. Pat. No. 3,419,391; an acyloxy group described in U.S. Pat. No. 3,311,476; a triazolyl group described in U.S. Pat. No. 3,415,652; an alkoxycarbonyloxy group; an arylidene or alkylidene group described in U.S. Pat. Nos. 2,706,683, 2,618,641, 3,468,666; and the like.

Typical preferred magenta-forming couplers include the following couplers.

M-1. 1-(3-Sulfo-4-phenoxyphenyl-3-heptadecyl-5-pyrazolone potassium salt

M-2. 1-Phenyl-3-(α-octadecenylsuccin-monoamido)-5-pyrazolone

M-3. 1-Phenyl-3-{2-chloro-4-[β-N-(4-n-dodecylphenyl)-acetylamino-β-carboxypropylamino]anilino}-5-pyrazolone M-4. 1-Phenyl-3-{3-[α-(2,4-di-sec-amylphenoxy)acetamido]-benzoylamino}-5-pyrazolone M-5. 1-(2,4,6-Trichlorophenyl)-3-3-[α-(2,4-di-t-amylphenoxy)butyramido]benzoylamido-5-pyrazolone M-6. 1-Phenyl-3-{3-[α-(3-oentadecylphenoxy)-butyramido]-phenyl}ureido-5-pyrazolone M-7. 1-(2,6-Dichloro-4-methoxyphenyl)-3-{3-[α-(2,4-di-t-amylphenoxy)butyramido]phenyl}ureido-5-pyrazolone M-8. 1-(2,4,6-Trichlorophenyl)-3-(2-chloro-5-myristoylamidoanilino)-5-pyrazolone M-9. 1-Phenyl-3-(2-chloro-5-tetradecyloxycarbonylanilino)-5-pyrazolone M-10. 1-(2,4,6-Trichlorophenyl-3-{3-[α-(2,4-di-t-amylphenoxy)acetamido]benzamido}-5-pyrazonyl(4)benzyl carbonate M-11. 1-(2,4,6-Trichlorophenyl)-3-(2,4-dichloroanilino)-4-(3-N-octadecylcarbamylphenylthio)-5-pyrazolone M-12. 1-(2,4,6-Trichlorophenyl)-3-{3-[α-(2,4-di-t-amylphenoxy)acetamido]benzamido}-4-(4-methoxyphenylazo)-5-pyrazolone M-13. 1-(2,4,6-Trichlorophenyl)-3-(3,5-dimethoxycarbonylanilino)-4-(3-N-n-octadecylcarbamoylphenylthio)-5-pyrazolone M-14. 1-(2,4,6-Trichlorophenyl)-3-(2,4-dichloroanilino)-4-(4-N-methyl-N-n-octadecylsulfamoylphenylthio)-5-pyrazolone As the nuclei for the couplers to be used in the present invention providing a cyan dye, compounds having a phenolic hydroxy group, in particular, phenolic compounds and α-naphtholic compounds, are useful. Of these, phenol derivatives substituted with an acylamino group at the o— or m-position and α-naphthol derivatives substituted with a carbamyl group at the 2-position are particularly useful. The ballasting group containing a hydrophobic residue is usefully introduced into the coupler nucleus as the acylamino group or as the carbamyl group. In these couplers, the p-position to the hydroxy group is the reaction site with an oxidized aromatic primary amino color developing agent. This reaction site is either unsubstituted or substituted with a residue which can be eliminated by the oxidized developing agent. Other nucleus positions can be substituted with a halogen atom, an alkyl group, an alkoxy group, an aryloxy group, an acylamino group, a sulfonamido group, a carbamyl group, a sulfamyl group, an alkoxycarbonyl group, a cyano group, a nitro group, a carboxy group, a sulfo group, a heterocyclic group (e.g., a 2-triazolyl group, a 2-imidazolyl group, etc.), and the like. The phenolic hydroxy group can be converted to an acylated form which can be hydrolyzed by an alkaline aqueous solution. The ballasted couplers to be advantageously used in the present invention providing non-diffusible cyan dye can be selected from among those described in the aforesaid reviews by Mees and James, supra, and by Pelz, supra, or other literature. 2-Naphthamide couplers having a sulfo group, described BIOS 1901, FIAT 943; acylaminophenol couplers described in U.S. Pat. Nos. 2,367,531, 2,369,929, 2,423,730; diacylaminophenol couplers described in U.S. Pat. Nos. 2,772,162 and 2,895,826; oil-soluble 2-naphthamide couplers described in U.S. Pat. No. 2,474,293; N,N-di-substituted naphthamide couplers described in U.S. Pat. No. 3,591,383; and the like are particularly useful for the practice of the present invention. These phenol derivatives can be substituted at the 4-position with a halogen atom such as a fluorine atom or a chlorine atom; an arylazo group; a heterocyclic azo group; an arylthio group; a heterocyclic thio group; an alkoxy group; an aryloxy group; a thiocyano group described in U.S. Pat. No. 3,253,924; an imido group described in U.S. Pat. No. 3,458,315; an aminomethyl group described in U.S. Pat. No. 3,419,390, or the like.

Typical preferred cyan-forming couplers include the following couplers:

C-1. 1-Hydroxy-4-sulfo-N-octadecyl-2-naphthamide sodium salt

C-2. 1-Hydroxy-2′-(N-methyl-N-octadecylamino)-5′-sulfo-2-naphthanilide potassium salt C-3. 1-Hydroxy-N-[β-(α-sulfo-stearoylamido)ethyl]-2-naphthanilide sodium salt C-4. 1-Hydroxy-N-[γ-(2,4-di-t-amylphenoxy)-propyl]-2-naphthamide C-5. 1-Hydroxy-4-chloro-N-dodecyl-2-naphthamide C-6. 1-Hydroxy-2′-chloro-5′-{[β-(2,4-di-t-amylphenoxy)-ethoxy]carbonyl}-2-naphthanilide C-7. 4,6-Dichloro-5-methyl-2-[α-(2,4-di-t-amylphenoxy)-butyramido]phenol C-8. 2-Heptafluorobutylamido-5-[α-(2,4-di-t-amylphenoxy)-caproylamino]phenol C-9. 1-Hydroxy-4-(2-ethoxycarbonylazo)-N-(2-ethylhexyl)-2-naphthamide The couplers to be used in the present invention providing diffusible dyes are reactive, non-diffusible, substantially colorless compounds which are capable of coupling with an oxidized developing agent and which, as a result of the coupling reaction, can eliminate and release a dye soluble and diffusible in the development processing composition. Such couplers are represented by the following general formula;

$$(Cp) - L - (Bl)$$

wherein Cp represents a coupling reactive structure moiety in which the coupling position is substituted by a (Bl)-L-residue and, when the coupler is to be used in combination with a developing agent not having a water-solubilizing group such as a sulfo group or a carboxy group, the Cp residue has a water-solubilizing group (e.g., a sulfo group, a carboxy group, a sulfonamido group, etc.) in at least one non-coupling position. Many functional groups which are known to undergo an oxidative coupling reaction with an aromatic primary amino color developing agent can be illustrated as the coupling reactive structure moiety to be utilized as Cp. Those described hereinbefore as the nuclei of the couplers providing non-diffusible dyes can similarly be used. For example, phenols, anilnes, cyclic or open-chain active methylene compounds, and hydrazones are suitable. Specific examples of particularly useful reactive structure moieties include those derived from acylamino-substituted phenols, 1-hydroxy-2-naphthoic acid amides, N,N-dialkylanilines, 1-aryl-5-pyrazolones (the 3-position being substituted by an alkyl group, an aryl group, an alkoxy group, an aryloxy group, an amino group, an acylamino group, an ureido group or a sulfonamido group), pyrazolobenzimidazoles, pyrazolotriazoles, α-cyanoacetophenones and α-acylacetanilides.

An azo group, an azoxy group, a mercuryl group (—Hg—), an oxy group, a thio group, a dithio group, a triazolyl group, a diacylamino group, an acylsulfonamino group

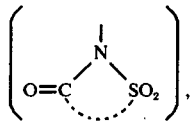

an acyloxy group, a sulfonyloxy group and an alkylidene group are illustrative as the connecting or linkage group L whose bond to the coupler structure moiety is split by an oxidized developing agent. Of these groups, an oxy group, a thio group, a dithio group, a diacylamino group, an acyloxy group, etc., which are eliminated as an anion, are useful since the amount of the diffusible dyes to be released is great. The coupling position of the coupling structure moiety of the phenol or naphthol is preferably substituted with a group connected through an oxy group, a thio group or a diacyloxy group. Also, the coupling position of a pyrazolone is preferably substituted with an azo group, a thio group or an acyloxy group, and the coupling position of an acylacetanilide by an oxy group, a thio group or a diacylamino group. The hydrophobic residues contained in the residues represented by Bl are essentially the same as the aforesaid hydrophobic groups of the couplers providing non-diffusible dyes, and impart a cohesive force between the coupler molecules in an aqueous medium to render the molecule non-diffusible in a hydrophilic colloid of a light-sensitive material. Advantageously a substituted or unsubstituted alkyl group, an alkenyl group, an aralkyl group and an alkylaryl group, having 8 or more carbon atoms, can be advantageously used as hydrophobic residues. For example, a lauryl group, a stearyl group, an oleyl group, a 3-n-pentadecylphenyl group, a 2,4-di-t-amylphenoxy group, and the like are useful. These hydrophobic residues can be connected, directly or through a divalent bond such as an amido bond, an ureido bond, an ether bond, an ester bond or a sulfonamido bond, to a residue such as an aryl group or a heterocyclic group to form Bl. The water-solubilizing group contained in the residue represented by Cp is an acidic group cabable of being substantially dissociated in a processing composition or a precursor group which provides such an acidic group upon hydrolysis. In particular, acidic groups having a pKa of not more than 11 are useful. Examples of such groups are a sulfo group, a sulfuric ester group (—O—$SO_3H$), a carboxy group, a sulfonamido group, a diacylamino group, a cyanosulfonamino group, a phenolic hydroxy group, etc.

The diffusible dye-releasing couplers to be used in the present invention undergo, upon reaction with an oxidized developing agent, cleavage of the L to provide a soluble dye, which is an oxidative coupling reaction product between Cp and the developing agent, and a non-diffusible, substantially colorless, eliminated product derived from Bl-L-. The resulting soluble dye diffuses into an image-receiving layer to form a dye image there.

Examples of diffusible dye-providing couplers to be used in the present invention with advantage are the following couplers:

α-(4-Methoxybenzoyl)-α-(3-octadecylcarbamylphenylthio)-3,5-dicarboxyacetanilide

α-Pivaloyl-α-(3-octadecylcarbamylphenylthio)-4-sulfoacetanilide potassium salt

1-Phenyl-3-(3,5-dicarboxyanilino)-4-(3-octadecylcarbamylphenylthio)-5-pyrazolone 1-Phenyl-3-(3,5-disulfobenzoylamino)-5-(2-hydroxy-4-n-pentadecylphenylazo)-5-pyrazolone 1-[4-(3,5-Dicarboxybenzamido)phenyl]-3-ethoxy-4-(3-octadecylcarbamylthio)-5-pyrazolone 1-Hydroxy-4-(3-octadecylcarbamylphenylthio)-N-ethyl-3′,5′-dicarboxy-2-naphthanilide 1-Hydroxy-4-(n-octadecylsuccinamido)-N-ethyl-3′,-5′-dicarboxy-2-naphthanilide Other specific examples of diffusible dye-releasing couplers and the synthesis thereof are described in British Pat. Nos. 840,731, 904,364, 1,085,631, U.S. Pat. Nos. 3,476,563, 3,644,498, and 3,419,391.

The development inhibitor-releasing compounds (the so-called DIR compounds) to be used in the present invention are either (1) couplers which, upon the coupling reaction with the oxidation product of an aromatic primary amide color developer, release a substituent at the reaction site, which substituent becomes a development inhibitor or (2) compounds which imagewise release a development inhibitor, for example, those compounds which, upon a subsequent reaction thereof in an oxidized state as a result of development with hydroxide ion, sulfite ion or like processing substance, release a development inhibitor. The DIR compounds to be used in the present invention must contain in the molecule a hydrophobic residue having 8 or more carbon atoms and must be ballasted. Those commonly used hydrophobic residues for ordinary ballasted couplers can be utilized. The eliminatable group in the DIR compounds can initially possess a chemical structure having a development-inhibiting effect prior to elimination or can complete a chemical structure having a development-inhibiting effect only after elimination. Useful development inhibitors are iodide ion, alkylmercaptans, arylmercaptans, heterocyclic mercaptans, triazoles, imidazoles, purine nucleus compounds, and the like. In particular, mercaptotriazoles, mercaptotetrazoles, mercaptopyrimidines, mercaptothiazines, mercaptoxazoles, mercaptoimidazoles, mercaptothiazoles and benzotriazoles exhibit a high inhibiting effect. Illustrative specific examples are 4-nitro-thiophenol, 2-ethoxycarbonylthiophenol, 1-phenyl-5-mercaptotetrazole, 2-mercaptobenzothiazole, 2-mercapto-4,6,6-trimethylpyrimidine, 5-bromobenzotriazole, etc. In order to avoid preventing development of the unexposed areas, it is preferable to introduce these inhibitor structures into the reaction site of the DIR compounds through a chemical bond which blocks the development-inhibiting center (e.g., an iodinecarbon bond, a thioether bond, a bond of carbon and an N-triazolyl group, etc.) rather than to introduce the inhibitor with the structure capable of exerting development-inhibiting action thereof into the DIR couplers. DIR couplers to be used in the present invention with advantage can be either those which provide a colored coupling product and a development inhibitor, as described in U.S. Pat. Nos. 3,148,062, 3,227,550, 3,227,551, 3,227,554, 3,617,291, or those which provide a colorless coupling product and a development inhibitor, as described in U.S. Pat. No. 3,632,345.

Typical preferred DIR couplers include the following compounds:

DIR Y-1. a-Pivaloyl-α-(1-phenyl-5-tetrazolylthio)-2-chloro-5-[γ-(2,4-di-t-amylphenoxy)-butyramido]acetanilide DIR Y-2. α-(4-Methoxybenzoyl)-α-(1-phenyl-5-tetrazolylthio)-2-chloro-5-[α-(2,4-di-t-amylphenoxy)butyramido]-acetanilide DIR Y-3. α-Benzoyl-α-(1-phenyl-5-tetrazolylthio)aceto-2-methoxy-5-n-tetradecyloxycarbonylanilide DIR M-1. 1-{4-[α-(2,4-Di-t-amylphenoxy)-butyramido]phenyl}-3-(1-piperidino)-4-(1-phenyl-5-tetrazolylthio)-5-pyrazolone DIR M-2. { 4-(2-Benzotriazolyl)-1-(2,4,6-trichlorophenyl)-3-{3-[α(2,4-di-t-amylphenoxy)acetamido]benzamido}-5-pyrazolone DIR M-3. 1-Benzyl-3-(3-myristoylamino-4-methoxy)-4-(5-bromobenzotriazolyl-1)-5-pyrazolone DIR C-1. 1-Hydroxy-4-(1-phenyl-5-tetrazolylthio)-N-[γ-(2,4di-t-amylphenoxy)propyl]-2-naphthamide DIR C-2. 1-Hydroxy-4-(2-nitrophenylthio)-N-octadecyl-3′,5′-dicarboxy-2-naphthanilide DIR C-3. 1-Hydroxy-4-(1-phenyl-5-tetrazolylthio)-N-(2-chloro5-n-tetradecyloxycarbonylphenyl)-2-naphthamide DIR U-1. α-(1-phenyl-5-tetrazolylthio)-2-sulfo-4-n-hexadecyloxyacetophenone potassium salt DIR hydroquinone derivatives to be used in the present invention with advantage are hydroquinone derivatives substituted at the nucleus with a development inhibitor group, and examples are described in U.S. Pat. Nos. 3,297,445, 3,364,022 and 3,379,529. These derivatives release, upon being oxidized through development, a development inhibitor by the action of a nucleophilic body in the processing solution such as hydroxide ion or sulfite ion.

Typical examples of prefered DIR hydroquinone derivatives include the following compounds:

DIR H-1. 2-t-Octyl-5-(1-phenyl-5-tetrazolylthio)hydroquinone

DIR H-2. 2-n-Pentadecyl-5-(1-phenyl-5-tetrazolylthio)-hydroquinone

DIR H-3. 2-n-Octadecylthio-5-(1-phenyl-5-tetrazolylthio)-hydroquinone

DIR H-4. 3-n-Octadecylthio-5-phenylthio-6-(1-phenyl-5-tetrazolylthio)hydroquinone Suitable aromatic primary amino developing agents to be used in the present invention are p-aminophenols, p-phenylenediamines and derivatives thereof. In particular, 2-chloro-4-aminophenol, 2,6-dibromo-4-aminophenol, 4-amino-N,N-diethyl-3-methylaniline, N,N-diethyl-p-phenylenediamine, N-ethyl-β-methanesulfonamidoethyl-3-methyl-4-aminoaniline, 4-amino-N-ethyl-N-(δ-sulfobutyl) aniline, 4-amino-N-ethyl-N-(β-hydroxyethyl)aniline, 4-amino-3-methyl-N-ethyl-N-(β-hydroxyethyl)aniline, 4-amino-N-ethyl-N-(β-carboxyethyl)-aniline, 4-amino-N,N-bis(β-hydroxyethyl)-3-methyl aniline, 3-acetamido-4-amino-N,N-(β-hydroxyethyl)aniline, 4-amino-N-ethyl-N-(2,3-dihydroxypropyl)-3-methylaniline, 4-amino-N,N-diethyl-3-(3-hydroxypropoxy)aniline, 4-amino-N-ethyl-N-(β-hydroxyethyl)-3-methoxyaniline and the salts of these anilines such as the hydrochlorides, sulfates, oxalates, p-toluenesulfonates, etc. are useful. Furthermore, precursors of developing agents, such as the Schiff bases of these anilines and phthalimides, are useful since they can be added to a light-sensitive element.

The ballasted couplers to be used in the present invention can be dispersed in a carrier, hydrophilic colloid, using various methods depending upon the type of dye image-providing material. For example, couplers having a dissociative group such as a sulfo group or a carboxy group can be added to a hydrophilic colloid solution after being dissolved in water or in an alkaline aqueous solution. With the couplers which are slightly soluble in an aqueous medium and readily soluble in an organic solvent, these couplers are first dissolved in an organic solvent, and then the resulting solution is added to a hydrophobic colloid solution, followed by stirring or the like to disperse the solution as fine particles. Suitable solvents are ethyl acetate, tetrahydrofuran, methyl ethyl ketone, cyclohexanone, β-butoxy-β-ethoxyethyl acetate, dimethylformamide, dimethyl sulfoxide, 2-methoxyethanol, tri-n-butylphthalate, etc. Of these dispersion solvents, those solvents which possess a comparatively high vapor pressure can be vaporized upon drying of the photographic layers, or can be vaporized according to the method described in U.S. Pat. Nos. 2,322,027 and 2,801,171 prior to coating. Of these dispersion solvents, those solvents which are readily soluble in water can be removed by washing with water according to U.S. Pat. Nos. 2,949,360 and 3,396,027.

In order to stabilize the dispersion of the coupler and accelerate the dye image-forming step, it is advantageous to incorporate, in a light-sensitive material, a solvent which is substantially insoluble in water and has a boiling point of not less than about 200° C at ordinary pressure together with the coupler. Examples of high boiling solvents suitable for this purpose are fatty acid esters such as triglycerides of higher fatty acids and dioctyl adipate; phthalic esters such as di-n-butyl phthalate; phosphoric acid esters such as tri-o-cresyl phosphate and tri-n-hexyl phosphate; amides such as N,N-diethyllaurylamide; hydroxy compounds such as 2,4-di-n-amylphenol, and the like. Furthermore, in order to stabilize the dispersion of the coupler and to accelerate the step of dye image formation, it is advantageous to incorporate in a light-sensitive sheet a polymer having affinity for the solvent together with the coupler. As polymers having affinity for the solvent and being suitable for this purpose, there are shellac, phenol-formaldehyde condensates, poly-n-butyl acrylates, n-butyl acrylate-acrylic acid copolymers, n-butyl acrylate-styrene-methacrylamide copolymers, and the like. These polymers can be dissolved in an organic solution together with the coupler and then dispersed in a hydrophilic colloid, or can be added, as a hydrosol prepared by emulsion polymerization or the like, to a hydrophilic colloid dispersion of the coupler.

In general, the dispersion of the coupler can be effectively counducted under great shearing force. For example, a high speed rotary mixer, a colloid mill a high pressure milk homogenizer, a high pressure homogenizer described in British Pat. No. 1,304,264, an ultrasonic emulsifying apparatus, and the like are useful. The use of a surface active agent as an emulsifying aid markedly serves to disperse the dye image-providing material. Surface active agents useful for the dispersion of the dye image-providing material to be used in the present invention are sodium triisopropylnaphthalenesulfonate, sodium dinonylnaphthalenesulfonate, sodium p-dodecylbenzenesulfonate, sodium dioctyl sulfosuccinate, sodium cetylsulfate and the anionic surface active agents described in Japanese Pat. Publication No. 4293/64. The combined use of these anionic surface active agents and higher fatty acid esters of anhydrohexitol exhibits particularly good emulsifying ability as described in U.S. Pat. No. 3,676,141.

The silver halide emulsion to be used in the present invention is a colloidal dispersion of silver chloride, silver bromide, silver chlorobromide, silver bromoiodide, silver chlorobromoiodide or a mixture thereof. The halide composition is selected depending upin the end-use purposes of the light-sensitive material and the processing conditions. In particular, a silver bromoiodide emulsion or silver chlorobromoiodide emulsion containing about 1 mol% to 10 mol% iodide, not more than about 30 mol% chloride and the balance bromide is desirable. Useful silver halide grains have a mean grain size of about 0.1 $\mu$ to about 2 $\mu$. For some end-use purposes of the light-sensitive material, silver halides having a uniform grain size are desirable. The grains can be in a cubic form, an octahedral form or in a mixed crystal form. These silver halide emulsions can be prepared according to known conventional processes as described in P. Glafkides; *Chimie Photographique* 2nd. Ed., Chapters 18 to 23, Paris (1957). That is, a soluble silver salt such as silver nitrate and a water-soluble halide such as potassium bromide are reacted with each other in the presence of a solution of a protective colloid such as gelatin and crystals are allowed to develop in the presence of excess halide or a solvent for silver halide such as ammonia. In this occasion, a single or twin jet method or a pAg-controlled twin jet method can be employed as the precipitating method. Removal of the soluble salts from the emulsion can be effected by washing and dialysis of the cool-set emulsion, by the combination of the addition of a sedimenting agent such as an anionic polymer having sulfone groups, sulfuric ester groups or carboxy groups or an anionic surface active agent and the adjustment of pH, or by the combination of the use of an acylated protein such as phthaloyl gelatin as a protective colloid and the adjustment of pH, to thereby cause sedimentation.

The silver halide emulsions to be used in the present invention are preferably subjected to chemical sensitization by heat treatment using the natural sensitizers contained in gelatin, a sulfur sensitizer such as sodium thiosulfate of N,N,N'-trimethylthiourea, a gold sensitizer such as a thiocyanate complex salt or thiosulfate complex salt of monovalent gold, or a reducing sensitizer such as stannous chloride or hexamethylenetetramine. Also emulsions which tend to form a latent image on the surface of the silver halide grains and emulsions which tend to form a latent image inside the silver halide grains as described in U.S. Pat. Nos. 2,592,550, 3,206,313, etc. can be used in the present invention.

The silver halide emulsions to be used in the present invention can be stabilized with additives such as 4-hydroxy-6-methyl-1,3,3a,7-tetrazaindene, 5-nitroimidazole, 1-phenyl-5-mercaptotetrazole, 8-chloromercuriquinoline, benzenesulfinic acid, pyrocatechin, etc. In addition, inorganic compounds such as cadmium salts, mercury salts, complex salts of platinum group metals such as the chloro complex salt of palladium, and the like are also useful for stabilizing the light-sensitive material of the present invention. Furthermore, the silver halide emulsions to be used in the present invention can contain sensitizing compounds such as a polyethylene oxide compound.

The photographic emulsion can be subjected to, if desired, optical sensitization and super-sensitization using cyanine dyes such as the cyanines, merocyanines, carbocyanines, etc. individually or in combination or, further, in combination with a styryl dye. Color-sensitizing techniques have long been known and are described in, for example, U.S. Pat. Nos. 2,493,748, 2,519,001, 2,977,229, 3,480,434, 3,672,897, 3,703,377, 2,688,545, 2,912,329, 3,397,060, 3,615,635, 3,628,964, British Pat. Nos. 1,195,302, 1,242,588, 1,293,862, German Pat. OLS No. 2,030,326, 2,121,780, Japanese Pat. Publication Nos. 4936/68, 14030/49, 10773/68, U.S. Pat. Nos. 3,511,664, 3,522,052, 3,527,641, 3,615,613, 3,615,632, 3,617,295, 3,635,721, 3,694,217, British Pat. Nos. 1,137,580, 1,216,203, etc. They can be optionally selected depending upon the end use of the light-sensitive material such as wavelength region to be sensitized. Specific examples of optical sensitizing agents are described in P. Grafkides, supra, Chapters 35 to 41, and in F. M. Hamer; *The Cyanine Dyes and Related Compounds* (Interscience). In particular, cyanines in which a nucleus nitrogen atom is substituted with aliphatic group having a hydroxy group, a carboxy group or a sulfo group, e.g., those described in U.S. Pat. Nos. 2,503,776, 3,459,553 and 3,177,210, are especially useful for the practice of the present invention.

The processing solution permeable layers to be used in the invention such as the silver halide emulsion layer, the dye-forming coupler-containing layer and the auxiliary layers (e.g., a protective layer, etc.) contain a hydrophilic polymer as a binder. Suitable hydrophilic polymers are gelatin, casein, gelatin modified with an acylating agent or the like, vinyl polymer-grafted gelatin, proteins such as albumin, cellulose derivatives such as hydroxyethyl cellulose, methyl cellulose, carboxymethyl cellulose, etc., polyvinyl alcohol, partially hydrolyzed products of polyvinyl acetate, polyvinyl pyrrolidone, high molecular weight nonelectrolytes such as polyacrylamide, polyacrylic acid, partially hydrolyzed products of polyacrylamide, anionic synthetic polymers such as vinyl methyl ether-maleic acid copolymers, N-vinylimidazoleacrylic acid-acylamide copolymers, synthetic polymer amphoteric electrolytes such as polyacrylamide having been subjected to the Hoffman reaction. These hydrophilic polymers can be used individually or in combination. Furthermore, these hydrophilic polymer layers can contain a latex-like polymer dispersion of hydrophobic monomers such as alkyl acrylate, alkyl methacrylate, etc. These hydrophilic polymers, particularly polymers having functional groups such as an amino group, a hydroxy group or a carboxy group, can be rendered insoluble using various crosslinking agents without loss of processing solution permeability. Particularly useful cross linking agents include aldehyde compounds such as formaldehyde, glyoxal, glutaraldehyde, mucochloric acid, acrolein oligomer, etc.; aziridine compounds such as triethylenephosphoramide described in Japanese Pat. Publication No. 8790/62; epoxy compounds such as 1,4-bis(2',3'-epoxypropoxy)diethyl ether described in Japanese Pat. Publication No. 7133/59; active halogen compounds such as 2-hydroxy-4,6-dichloro-s-triazine sodium salt as described in U.S. Pat. No. 3,325,287; active olefin compounds such as hexahydro-1,3,5-triacryl-s-triazine; methylol compounds such as N-polymethylol urea, hexamethylol melamine, etc.; high molecular weight compounds such as dialdehyde starch or 3-hydroxy-5-chloro-s-triazinyl gelatin as described in U.S. Pat. No. 3,362,827, etc. These hydrophilic polymers can contain a cross linking-accelerating agent such as a carbonate or resorcin as well as the cross linking agent.

The photographic layers to be used in the present invention can be coated using various coating methods such as a dip coating method, a roller coating method, an air knife coating method, a bead coating method described in U.S. Pat. No. 2,681,294, a curtain coating method described in U.S. Pat. Nos. 3,508,947 and 3,513,017, etc. In particular, with light-sensitive elements of a multilayered structure, it is convenient to coat a number of layers at one time using a multi-slit hopper described in U.S. Pat. Nos. 2,761,417, 2,761,418, 2,761,419 and 2,761,791.

In order to facilitate the coating of the photographic layers to be used in the present invention, the coating composition advantageously can contain a variety of surface active agents as a coating aid. Illustrative useful coating aids include nonionic surface active agents such as saponin, p-nonylphenol, ethoxyethylene adducts, alkyl ethers of sucrose, glycerin monoalkyl ethers, etc., anionic surface active agents such as sodium dodecylsulfonate, sodium p-dodecylbenzenesulfonate, sodium dioctylsulfosuccinate, etc., and amphoteric surface active agents such as carboxymethyldimethyllaurylammonium hydroxide inner salt, "Deriphat 151" trade name, produced by General Mills, betaine compounds described in U.S. Pat. No. 3,441,413, British Pat. No. 1,159,825 and Japanese Pat. Publication No. 21985/71.

In order to facilitate the coating of the photographic layers to be used in the present invention, the coating composition can contain various thickening agents. For example, in addition to those which increase the viscosity of the coating composition due to their own viscosity such as high molecular weight polyacrylamide, anionic polymers such as cellulose sulfate, poly-p-sulfostyrene potassium salt and acrylic polymers described in U.S. Pat. No. 3,655,407 which exhibit a thickening action due to the mutual interaction with a binder polymer contained in the coating composition are similarly useful.

The reversal emulsion layer to be used in the present invention can contain various auxiliary layers in addition to the hydrophilic colloid layer containing spontaneously developable silver halide grains and the negative type light-sensitive silver halide emulsion layer containing a development inhibitor-releasing compound. For example, an interlayer can be positioned between the above-described two layers. This layer advantageously comprises a hydrophilic colloid layer containing a compound capable of trapping an oxidation product of an aromatic primary amine developing agent. Useful trapping agents for an oxidation product of the developing agent are hydroquinone derivatives described in U.S. Pat. Nos. 2,360,290, 2,418,613, 2,675,314, 2,701,197, 2,704,713, 2,710,801, 2,728,659, 2,732,300, 2,735,765 and 2,816,028 as well as the above-described couplers.

The reversal emulsion layer unit to be used in the present invention can have various structures. For example, it is advantageous to dispose one hydrophilic colloid layer containing spontaneously developable silver halide grains on both sides of the negative type light-sensitive silver halide emulsion layer containing a development inhibitor-releasing compound. Where one spontaneously developable silver halide layer is disposed for each negative type light-sensitive emulsion layer, it is advantageous to dispose the spontaneously developable silver halide layer adjacent the negative type light-sensitive emulsion layer toward the support side.

The light-sensitive material of the present invention advantageously contains two or more reversal emulsion layer units having a different light sensitivity. Most preferably, the lightsensitive material contains three reversal emulsion layer units, a blue-sensitive reversal emulsion layer unit, a green-sensitive reversal emulsion layer unit and a red-sensitive reversal emulsion layer unit. These units contain a spontaneously developable silver halide layer containing a yellow-forming coupler, a magentaforming coupler or a cyan-forming coupler. Furthermore, these units are preferably positioned in the order of a blue-sensitive unit, a green-sensitive unit and a red-sensitive unit or of a blue-sensitive unit, a red-sensitive unit and a green-sensitive unit, from the side to be exposed to incident light of exposure. Also, a yellow filter layer is preferably positioned between the blue-sensitive unit and the other light sensitive units. From the viewpoint of color separation, it is desirable that these reversal emulsion units are separated from each other by an interlayer comprising a hydrophilic colloid layer containing an ingredient capable of trapping a diffusible development inhibitor to be released from the negative type light-sensitive silver halide emulsion layer. This interlayer desirably contains an ingredient capable of trapping an oxidation product of aromatic primary amino developing agent, for example, the aforesaid couplers and hydroquinone derivatives. As components capable of trapping and a development inhibitor, fine colloidal silver grains such as Carey-Lea type silver sol and fine silver halide grains having low light sensitivity such as a Lippmann type emulsion are useful.

The amount of coupler to be contained in a spontaneously developable silver halide layer of one reversal emulsion layer unit contained in a light-sensitive material of the present invention greatly varies depending upon the type of light-sensitive material and the kind of coupler. However, a coupler amount ranging from about $10^{-4}$ mol to about $10^{-2}$ mol per 1 $m^2$, in particular from $3 \times 10^{-4}$ to $6 \times 10^{-3}$, is employed with advantage. The amount of spontaneously developable silver halide is equivalent to about 30 times larger than the coupler in molar ratio. In particular, an amount 2 to 10 molar times the amount of the coupler is advantageously employed. The amount of silver contained in a negative type light-sensitive silver halide emulsion layer of one emulsion layer unit is advantageously about 1/10 to 4 times, the silver amount of the spontaneously developable silver halide in the same unit. The amount of development inhibitor-releasing compound to be added to a light-sensitive emulsion layer widely varies depending upon the kind of the compound and the developing conditions. In general, however, 1/80 to an equivalent amount, advantageously 1/20 to ¼ (molar ratio), based on the silver halide in the same emulsion layer can be employed.

The amount of the desensitizer to be added to spontaneously developable silver halide grains greatly varies mainly depending upon the kind of the desensitizer and the size of silver halide grains. Optimal amounts to be added can easily be decided by those skilled in the art through routine experimentation. Generally speaking, an amount ranging from about 10 mg to 1 g per 1 mol of silver halide can be employed.

Further in one embodiment, the light-sensitive element of the invention can be used as a light-sensitive element of a diffusion transfer color photographic film unit. Such a diffusion transfer color photographic film unit contains I. A light-sensitive element compring a support having thereon at least one emulsion layer unit comprising
   A. a hydrophilic colloid layer which is associated with a ballasted coupler capable of reacting with an oxidation product of an aromatic primary amino color developing agent and which contains spontaneously developable silver halide grains which are rendered substantially light-insensitive with a desensitizing dye, and
   B. a negative type light-sensitive silver halide emulsion layer which is adjacent layer (A) and which is associated with a compound capable of reacting with an oxidation product of an aromatic primary amino color developing agent to release a diffusible development inhibitor
II. an image-receiving element which receives diffusible dyes formed on development of the silver halide of the light-sensitive element (I) as a transferred image, and
III. a rupturable (e.g., using pressure-applying members) processing solution container retaining an alkaline processing solution for development of the silver halide of the light-sensitive element (I).

The light-sensitive element (I) in this embodiment can have the layer structure and can contain the components as described hereinbefore.

The image-receiving element (II) used in this embodiment fixes the diffusible dyes, etc., which are released in an imagewise distribution from dye image-forming materials such as the couplers associated with the silver halide emulsion. Where dye developers having a hydroquinonyl group or anionic substances such as color dyes having an acidic water-solubilizing group are used as the dye image-forming material, the image-receiving element preferably contains a basic polymer or a basic surface active agent. As the basic polymer, those polymers which contain tertiary or quaternary nitrogen atoms are excellent. More specifically illustrative examples are poly-4-vinylpyridine, a polymer of the aminoguanidine derivative of vinyl methyl ketone as described in U.S. Pat. No. 2,882,156, poly-4-vinyl-N-benzyl-pyridium-p-toluenesulfonate, poly-3-vinyl-4-methyl-N-n-butyl-pyridium bromide, styrene/N-(3-malemimidopropyl)-N,N-dimethyl-N-4-phenylbenzylammonium chloride copolymer as described in British Pat. No. 1,261,925, poly[N-(2-methacryloylethyl)-N,N-dimethyl-N-benzylammonium chloride], etc. As the basic surface active agent, those surface active agents which contain an onium residue such as an ammonium, sulfonium or phosphonium residue and contain a hydrophobic residue such as a long-chain alkyl group are excellent. More specifically, suitable examples are N-laurylpyridinium bromide, cetyltrimethylammonium bromide, methyl-tri-n-laurylammonium p-toluenesulfonate, methyl-ethyl-cetylsulfonium iodide, benzyltriphenylphosphonium chloride, etc. In addition to these basic compounds, multi-valent metals such as thorium, aluminum, zirconium, etc., also exert a fixing action on the anionic dye image-forming materials. These substances advantageously form films together with polymers such as gelatin (in particular acid-processed gelatin), polyvinyl alcohol, polyacrylamide, polyvinyl methyl ether, hydroxyethyl cellulose, N-methoxymethylpolyhexylmethyleneadipamide, polyvinylpyrrolidone, etc.

Where the dye image-forming material is one component for forming a dye such as a diffusible coupler, the imagereceiving layer contains other coupling components capable of reacting with this component to form a dye, such as a p-phenylenediamine derivative and an oxidizing agent, or a diazonium compound. This type of image-receiving element which can be used is described in U.S Pat. Nos. 2,647,049; 2,661,293; 2,698,244; 2,698,798; 2,802,735; 3,676,124, British Pat. Nos. 1,158,440; 1,157,507, etc.

The diffusion transfer color photographic film unit can contain a developing agent scavenger which reacts with excess developing agent remaining after the processing to form a colorless product which is difficult to oxidize. In particular, a film unit which contains the above-described scavenger in the acidic substance-containing neutralizing layer, in the timing layer or in the image-receiving layer of the film unit provides distinct images with less strain. Film units which contain an aromatic primary amino developing agent, which tends to cause stain, advantageously contain as the scavenger a compound having a functional group capable of condensing with amines, such as an isocyanate, an aldehyde precursor and a vinylsulfonyl compound as described in German Pat. OLS Nos. 2,201,392; 2,225,480 and 2,225,497.

The diffusion transfer color photographic film unit preferably possesses the function of neutralizing the alkali brought thereinto into from processing composition. The processing composition contains alkali so as to provide a pH of higher than about 10, preferably higher than 11, which is sufficiently high to accelerate the image-forming steps comprising the development of the silver halide emulsion, the formation of the diffusible dyes and the diffusion transfer. After the substantial completion of the formation of the diffusion transferred images, the pH in the film unit is reduced to around neutrality, i.e., less than about 9, preferably less than 8, whereby further image-formation is actually discontinued to prevent the image tone from being changed with the lapse of time and to control discoloration and fading of the images and stain of white background due to high alkalinity. For this purpose, the film unit advantageously contains a neutralizing layer containing an acidic substance in a sufficient quantity to neutralize the alkali contained in the processing composition to the above-described pH, that is, in an area concentration equivalent to or greater than the amount of alkali contained in the spread processing composition. Preferred acidic substances are those which contain an acidic group having a pKa of less than about 9, particularly a carboxy group or a sulfonic acid group, or which contain a precursor group capable of providing such an acidic group upon hyrolysis. More preferred examples are higher fatty acids such as oleic acid as described in U.S. Pat. No. 2,983,606, polymers of acrylic acid, methacrylic acid or maleic acid, the partially esterified polymers thereof, or acid anhydrides. Specific examples of high molecular weight acidic substances are copolymers of a vinyl monomer (e.g., ethylene, vinyl acetate, vinyl methyl ether, etc.) and maleic anhydride, and the n-butyl half ester thereof; copolymers of butyl acrylate and acrylic acid; cellulose acetate, hydrogen phthalate; and the like. In addition to these acidic substances, the neutralizing layer can contain polymers such as cellulose nitrate and polyvinyl acetate, and a plasticizer as described in U.S. Pat. No. 3,557,237. Furthermore, the neutralizing layer can be hardened through cross linking with a multifunctional aziridine compound, an epoxy compound, etc. The neutralizing layer can be positioned in either the image-receiving element and/or the lightsensitive element. In particular, the neutralizing layer is advantageously positioned between the support of the image-receiving element and the image-receiving layer. As is described in German Pat. OLS No. 2,038,254, the acidic substances can be microencapsulated for incorporation in the film unit.

The neutralizing layer or the acidic substance-containing layer used in the present invention is desirably separated from the spread processing composition layer by a neutralization rate-controlling layer or timing layer. This timing layer functions to prevent a disadvantageous reduction in the transfer image density due to a too fast reduction in pH before the necessary development of the silver halide emulsion layer and the formation of the diffusion transfer image are completed. That is, this layer functions to delay the reduction in the pH until the necessary development and transfer are completed. In a preferred embodiment, the image-receiving element possesses a multi-layered structure comprising a support--a neutralizing layer--a timing layer--a mordant layer (image-receiving layer) in this sequence. The timing layer comprises mainly polymers such as gelatin, polyvinyl alcohol, polyvinyl propyl ether, polyacrylamide, hydroxypropylmethyl cellulose, isopropyl cellulose, copolymer of polyvinyl alcohol and polyvinyl butyral, partially hydrolyzed polyvinyl acetate, copolymers of $\beta$-hydroxyethyl methacrylate and ethyl acrylate, and the like. These polymers are usefully hardened through cross linking with an aldehyde compound such as formaldehyde, or an N-methylol compound. The timing layer preferably has a thickness of about 2 $\mu$ to 20 $\mu$.

The processing composition which can be used in the rupturable processing solution container is a liquid composition containing the processing components necessary for the development of the silver halide emulsion and necessary for the formation of the diffusion transfer dye image. The main solvent therein is water and, in some cases, a hydrophilic solvent such as methanol or methyl cellosolve is additionally present. The processing composition contains alkali in an amount sufficient to maintain the pH at a level necessary for causing development of the emulsion layer and neutralizing acids produced during the various steps of development and dye image formation. Typical alkalis are sodium hydroxide, potassium hydroxide, calcium hydroxide dispersion, tetramethylammonium hydroxide, sodium carbonate, trisodium phosphate, diethylamine, etc. The processing composition preferably possesses a pH of not less than about 12 at room temperature (about 20° – 30° C). More preferably, the processing composition contains a hydrophilic polymer such as a high molecular weight polyvinyl alcohol, hydroxyethyl cellulose, sodium carboxymethyl cellulose or the like. These polymers impart to the processing composition a viscosity of not less than about 1 poise, preferably about 1,000 poise, at room temperature, which not only facilitates the uniform spreading of the composition upon processing but also the formation of an immovable film, upon concentration of the processing solution due to migration of the aqueous solvent into the light-sensitive element and the image-receiving element in the course of the processing, thus serving to unify the film unit after processing. In addition, this polymer film can serve, after the substantial completion of the formation of the diffusion transfer dye image, to control further migration of coloring ingredients into the image-receiving layer, thereby preventing the image from being changed.

In some cases, the processing composition advantageously contains a light absorbent such as carbon black and a desensitizer as described in U.S. Pat. No. 3,579,333 so as to prevent the silver halide emulsion from being fogged by ambient light during processing. Furthermore, the processing composition advantageously contains additives such as a developer (e.g., a primary amino color developing agent, etc.), an antioxidizing agent (e.g., a sulfite, ascorbic acid, etc.), an antifogging agent (e.g., a halogen compound, 5-nitrobenzimidazole, etc.), and the like.

Suitable examples of silver halide solvents contained in the processing composition include alkali metal thiosulfate such as sodium thiosulfate and potassium thiosulfate, ammonium thiosulfate and alkyl ($CH_3$ or $C_2H_5$) bissulfonylmethane, etc. Alkali metal thiocyanates such as sodium and potassium thiocyanates, ammonium thiocyanate and uracil can be used in combination with the above compounds. A suitable amount is about 4 g/liter to 9 g/liter in the processing composition.

The processing composition used in the present invention is retained in a rupturable processing solution container (III). Such a container is advantageously produced by folding a sheet of a liquid- and air-impervious substance and sealing each edge to form a cavity in which the processing composition is retained, and the container is advantageously formed so that, when the film unit passes through pressure-applying members, the container is ruptured at a given portion due to the inner hydraulic pressure generated within the processing composition to thereby release the contents. Suitable advantageous materials for forming the container are a polyethylene terephthalate polyvinyl alcohol/polyethylene laminate, a lead foil/vinyl chloride-vinyl acetate copolymer laminate or the like. This container is desirably fixedly positioned and extends transverse a leading (i.e., in the direction of travel of the film unit with respect to the pressure applying members) edge of the film unit whereby to effect a substantially unidirectional discharge of the contents of the container on the surface of the light-sensitive element. Preferred examples of such containers are described in U.S. Pat. Nos. 2,543,181; 2,643,886; 2,643,732; 2,723,051; 3,056,491; 3,056,492; 3,152,515 and 3,173,580. These containers are advantageous for use in the diffusion transfer color photographic film unit.

The support which can be used in the present invention is a substantially planar substance which does not undergo any serious dimensional change due to the processing composition used during processing. For some purposes, rigid supports such as a glass plate can be used. However, in general, flexible supports are useful. Suitable flexible supports which can be advantageously used are those generally used for photographic light-sensitive materials, such as a cellulose nitrate film, a cellulose acetate film, a polyvinyl acetal film, a polystyrene film, a polyethylene terephthalate film, a polycarbonate film, etc. Supports having dimensional stability and oxygen impervious properties such as a laminate in which a polyvinyl alcohol layer is sandwiched between polyethylene terephthalate layers or between cellulose acetate layers is particularly desirable since the laminate serves to provide a stable dye image and is stained to a lesser extent. In the diffusion transfer color photographic film unit, in order to facilitate evaporation of moisture contained in the spread processing composition through the support after the processing, it is advantageous to use an aqueous vapor permeable support such as is described in U.S. Pat. No. 3,573,044. In order to prevent incident light leakage through the edge of the transparent support to the silver halide emulsion layer during the processing of the diffusion transfer color photographic film unit in a bright place, the transparent support is desirably colored to such extent that transmission of light in a planar direction to the support can be prevented without inhibiting imagewise exposure and observation therethrough. If desired, the support can contain a plasticizing agent such as a phosphoric ester, a phthalic ester, etc., an ultraviolet light-absorbing agent such as 2-(2-hydroxy-4-t-butylphenyl)benzotriazole, etc., an antioxidant such as a hindered phenol, etc. In order to maintain the adhesion between the support and the hydrophilic polymer-containing layer, it is advantageous to provide a subbing layer or to subject the surface of the support to a preliminary treatment such as corona discharge, irradiation with ultraviolet light or a flame treatment. The support usually has a thickness of about 20 to 300 $\mu$.

The present invention will now be illustrated in greater detail by the following non-limiting examples of preferred embodiments of the present invention. Unless otherwise indicated, all parts, percents, ratios and the like are by weight.

EXAMPLE 1 i. Preparation of Silver Halide Grains:

To a 65° C solution prepared by dissolving 80 g of potassium bromide, 5.0 g of potassium iodide and 10 g of gelatin in 700 ml of distilled water was added under mechanical stirring at 60° C a solution prepared by dissolving 90 g of silver nitrate in 900 ml of distilled water, in such manner that half of the solution was added in 1 minute and the remaining half in 29 minutes. Stirring was continued for 15 minutes while maintaining the temperature at 65° C. Then, 50 ml of an aqueous solution containing 3 g of a sodium salt of 1:1 molar ratio copolymer of methyl vinyl ether and maleic acid was added thereto and, after cooling to 30° C, a 10% sulfuric acid aqueous solution was added thereto to reduce the pH of the solution to 4.5. Silver halide grains were flocclate together with gelatin. This silver halide flocculate was washed 4 times with water at 25° C containing a small amount of sulfuric acid by decantation. To this were added 80 g of gelatin and water at 40° C to make to total 1.25 Kg. Then, a 1 N sodium hydroxide aqueous solution was added thereto to adjust the pH to 7.0, and thus the silver halide was redispersed.

Electron microscopic observation of this silver halide dispersion showed a particle size distribution as shown in FIG. 1 (numerical average: 0.81 $\mu$; standard deviation obtained by approximating the logarithmic normal distribution: 0.34 $\mu$).

ii. Provision Spontaneous Developability:

200 g of the above-described silver halide dispersion was removed, and 5 ml of a methyl alcohol solution containing $4 \times 10^{-6}$ mol N,N,N'-triethylthiourea was added thereto, followed by heat-treating at 75° C for 100 minutes under stirring.

iii. Rendering the Silver Halide Grains Light-Insensitive:

40 ml of Desensitizer S-1 (as described hereinbefore) was dissolved in 10 ml of $\beta$-phenoxyethanol under heating, and this solution was added to 60 ml of an aqueous solution containing 0.3 g of sodium p-dodecylbenzenesulfonate and 6.0 g of gelatin, followed by vigorous stirring to disperse. 20 g of this dispersion was added to 200 g of the heat-treated silver halide dispersion prepared in (ii) above, and stirring was continued for 30 minutes.

iv. Preparation of Emulsion Layer Unit:

A solution comprising 7.5 g of a yellow forming coupler, $\alpha$-pivaloyl-$\alpha$-(4-carboxyphenoxy)aceto-2-chloro-5-[$\alpha$-(3-pentadecylphenoxy)butyramido]anilide (Coupler Y-10), 5 ml of di-n-butyl phthalate and 15 ml of ethyl acetate was emulsified in 70 ml of an aqueous solution containing 5 g of gelatin and 0.4 g of sodium p-dodecylbenzenesulfonate under vigorous mechanical stirring. To this emulsion was added all of the light-insensitive silver halide dispersion obtained in (iii) above, and after adding thereto 10 ml of an acetone solution containing 300 mg of triethylenephosphoramide, the emulsion was coated on a cellulose acetate film base as a first layer in a dry thickness of 6 $\mu$.

On this was coated, as a second layer, an interlayer comprising 1.5 mg/100 cm$^2$ of 2,5-di-tert-octylhydroquinone, 3 mg/100 cm$^2$ of di-n-butyl phthalate and 13.5 mg/100 cm$^2$ of gelatin.

Further, to 100 g of a negative type light-sensitive silver halide emulsion containing $6.2 \times 10^{-2}$ mol silver bromoiodide (iodide content: 6 mol%; mean particle size: 1.2 $\mu$) and 6 g of gelatin was added a dispersion of a DIR coupler prepared as follows. The coupler dispersion was prepared by dissolving 3.9 g of 1-hydroxy-4-(1-phenyl-5-tetrazolylthio)-N-[$\gamma$-(2,4-di-tert-amylphenoxy)propyl]-2-naphthamide (DIR C-1) in a mixture of 4 ml of 4 ml of N,N-diethyllaurylamide and 8 ml of ethyl acetate under heating and mixing the resulting solution with 50 ml of an aqueous solution containing 0.2 g of sodium p-dodecylbenzenesulfonate and 4 g of gelatin, followed by vigorous mechanical stirring. Then, 4 ml of an aqueous solution containing 40 mg of 4-hydroxy-6-methyl-1,3,3a,7-tetrazaindene and 5 ml of an acetone solution containing 70 mg of triethylenephosphoramide were added thereto and coated in a dry thickness of 4.5 $\mu$.

Finally, gelatin was coated as a protective layer in a dry thickness of 1 $\mu$ to complete a light-sensitive material (Sample I-A).

In a manner analogous to the above-described procedures except for omitting step (iii) for rendering the silver halide grains light-insensitive by adding a desensitizer, a light-sensitive material (Sample I-B) was prepared.

These samples were subjected to sensitometry using blue light with various illuminances, and then to the following color development processing at a bath temperature of 25° C.

| Color Development Processing: | Time |
|---|---|
| 1. Color Development | 4 min. |
| 2. Stopping | 2 min. |
| 3. Bleaching | 4 min. |
| 4. Water Washing | 1 min. |
| 5. Fixing | 4 min. |
| 6. Water Washing | 5 min. |
| Color Developer Composition | |
| Ascorbic Acid | 0.2 g |
| 4-Amino-3-methyl-N-ethyl-N-(β-hydroxyethyl)aniline Sulfate | 30 g |
| Trisodium Phosphate | 50 g |
| Sodium Hydroxide | 8.0 g |
| Potassium Bromide | 1.4 g |
| Water to make | 1 liter |

The stopping bath was an aqueous solution containing acetic acid and sodium acetate and was buffered at a pH of 4.7. The bleaching solution was a neutral aqueous solution containing potassium ferricyanide and potassium bromide. The fixing solution was an acidic aqueous solution containing sodium thiosulfate, sodium sulfite and acetic acid.

Figure 2:
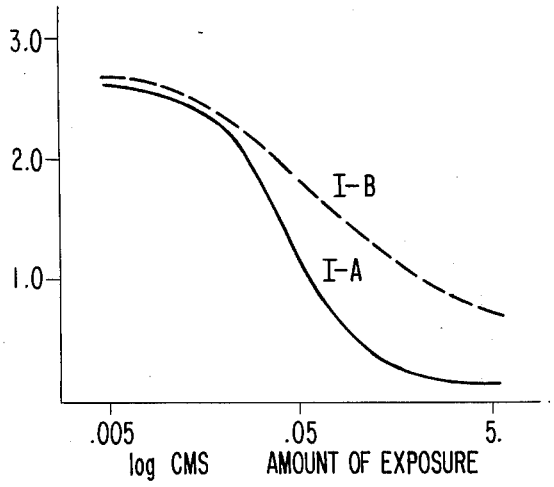
FIG. 2 is a graph showing characteristic curves of reversal images provided by an example of the light-sensitive material of the present invention and a control sample.

The characteristic curves of the resulting yellow dye reversal images are shown in FIG. 2. The characteristic curves show that Sample I-A in accordance with the present invention provides a reversal image having sufficiently low minimum density and high photosensitivity while, with control Sample I-B, the density at highlight areas was not sufficiently reduced and the light sensitivity was low.

Figure 3:
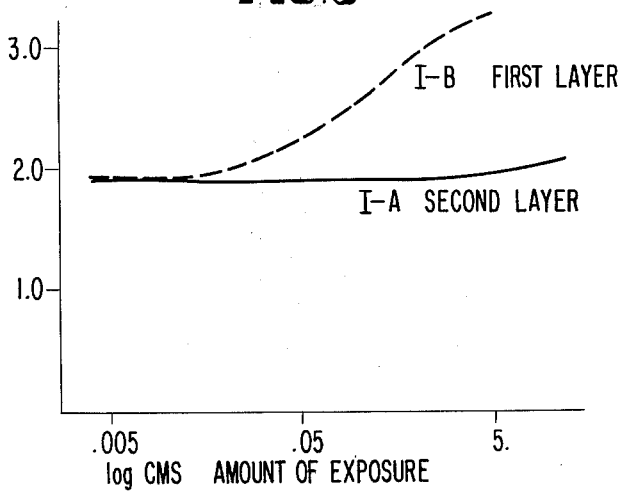
FIG. 3 is a graph showing the photosensitivity of the spontaneously developable silver bromoiodide layer used in an example of the present invention and that of a control sample.

Characteristic curves obtained by developing samples prepared by coating only the first layers of Samples I-A and I-B, respectively, for 2 minutes are shown in FIG. 3. From this, it is demonstrated that spontaneously developable silver halide grains are substantially completely rendered light-insensitive with Desensitizer S-1. On the other hand, the samples not processed with the desensitizing dye possesses residual photosensitivity against the light-sensitive emulsion. It is clear that this residual photosensitivity is the cause of the large minimum density of the emulsion layer unit of Sample I-B.

EXAMPLE 2

The procedures described in Example 1 were repeated except for changing the desensitizer to prepare light-sensitive materials, which were then similarly processed to obtain yellow reversal images. The characteristic values of the reversal images obtained are tabulated in the following table.

Table 1

| Desensitizer | | Characteristic Values of Reversal Image | | |
|---|---|---|---|---|
| Compound | Amount Used* (mg) | Relative Sensitivity | Maximum Sensitivity | Minimum Sensitivity |
| S-2 | 18 | 65 | 2.45 | 0.25 |
| S-5 | 10.5 | 100 | 2.55 | 0.12 |
| S-7 | 25 | 50 | 2.40 | 0.18 |
| S-8 | 10.5 | 125 | 2.30 | 0.08 |
| S-9 | 10.5 | 100 | 2.45 | 0.12 |
| S-10 | 15.5 | 50 | 2.45 | 0.17 |
| S-12 | 22 | 50 | 2.55 | 0.17 |
| S-13 | 22 | 100 | 2.40 | 0.10 |
| S-14 | 21 | 65 | 2.55 | 0.22 |
| No Desensitizer (Control) | — | 10 | 2.60 | 0.85 |

*Amount of desensitizer per 200 mg of a silver halide dispersion.

The above-described results show that the reversal light-sensitive materials of the present invention in which a desensitizer is incorporated in a spontaneously developable silver halide grain layer provide improved reversal characteristics as compared with the control sample in that high sensitivity and low minimum density are attained.

EXAMPLE 3

Silver halide grain dispersions having been rendered spontaneously developable and light-insensitive were prepared as follows.

i. (Dispersion 3A):

200 g of the silver halide grain dispersion described in Example 1, (i) was removed, and 10 ml of an aqueous solution containing 7 mg of sodium thiosulfate (anhydrous) and 3 mg of potassium gold (I) thiocyanate was added thereto, followed by heat treatment at 75° C for 150 minutes under stirring. After cooling to 35° C, an aqueous dispersion of a solution comprising 11 mg of Desensitizer S-1 having the aforesaid structure and 2.8 ml of β-phenoxyethanol was added thereto and stirred for 30 minutes. Then, a yellow coupler dispersion described in Example 1, (iv), was added thereto and, after adding 10 ml of an acetone solution containing 300 mg of triethylenephosphoramide, the emulsion was coated as a first layer in a dry thickness of 6 μ on a cellulose acetate film base.

ii. (Dispersion 3B):

200 g of the silver halide grain dispersion described in Example 1, (i), was removed, and 5 ml of an aqueous solution containing 1 mg of chloroauric acid (dihydrate) and then 5 ml of a methanol solution containing 4.5 mg of stannous chloride (dihydrate) were added thereto, followed by stirring for 60 minutes at 50° C. Thus, a spontaneously developable silver halide grain dispersion was prepared. To this were added the sensitizer, the coupler and the hardener, and the emulsion was coated in the same manner as the above-described Dispersion 3A.

iii. (Dispersion 3C)

200 g of the silver halide grain dispersion described in Example 1, (i), was removed, and 10 ml of an aqueous solution containing 15 mg of sodium sulfide (nonahydrate) and 0.5 g of gelatin was gradually added thereto at 45° C over 5 minutes under vigorous mechanical stirring to prepare a spontaneously developable silver halide grain dispersion. To this were added the desensitizer, the coupler and the hardener, and the emulsion was coated in the same manner as the above-described Dispersion SA.

iv. (Dispersion 3D):

Into aqeuous solution at 45° C comprising 73.6 g of ammonium bromide, 2.4 g of potassium iodide, 160 g of gelatin and 960 cc of water was poured an aqueous solution at 20° C containing 56 g of silver nitrate, 60 ml of 25% aqueous ammonia and 200 ml of water, and stirred for 5 minutes at 45° C. Then, an aqueous solution at 20° C containing 28 g of silver nitrate, 30 ml of 25% aqueous ammonia and 120 ml of water was poured thereinto, and stirred for 5 minutes at 45° C. Finally, an aqueous solution at 20° C containing 28 g of silver nitrate, 30 ml of 25% aqueous ammonia and 120 ml of water was poured thereinto, and the emulsion ripened for 20 minutes at 45° C. After cool-setting, the emulsion was cut into pieces and washed with water at 10° C for 120 minutes. Electron microscopic observation showed that the mean grain size of this silver bromoiodide dispersion was 0.7 $\mu$ and grains of not more than 0.3 $\mu$ in size were extremely small in number. 200 g of this dispersion (containing $5.54 \times 10^{-2}$ mol silver halide) was removed, and 5 ml of an aqueous solution containing 5.5 mg of sodium thiosulfate (anhydrous) was added thereto and the emulsion was subjected to heat-treatment for 90 minutes at 70° C under stirring. To this was added a solution comprising 18 mg of Desensitizer S-2, 0.2 g of sodium hydroxide, 3 ml of methyl alcohol and 2 ml of water, and left for 15 minutes at 35° C under stirring. Subsequently, 85 ml of an aqueous solution containing 4.2 g of $\alpha$-(4-n-octadecyloxybenzoyl)aceto-2-methoxy-5-sulfoanilide potassium salt (Coupler Y-3) was added thereto and, after adjusting the pH to 6.0 by a 5% citric acid aqueous solution, 5 ml of a solution containing 200 mg of triethylenephosphoramide was added thereto, followed by coating the emulsion in a dry thickness of 7 $\mu$ on a cellulose acetate film.

Control samples for the respective coated samples were prepared in the same manner as the above-described four spontaneously developable silver halide grain dispersions except for omitting the addition of the desensitizing dye.

On each of these 8 coatings were coated, in sequence, the second layer, the third layer and the protective layer described in Example 1 to thereby complete reversal emulsion layer units.

These samples were subjected to blue light sensitometry and development-processed in the same manner as in Example 1 to obtain yellow reversal images.

The sensitometric characteristics of these samples are as shown in the following table.

Table 2

| Spontaneously Developable Silver Halide Dispersion | Desensitizer | Characteristic Values of Reversal Image | | |
|---|---|---|---|---|
| | | Relative Sensitivity | Maximum Sensitivity | Minimum Sensitivity |
| 3A | S-1 | 100 | 2.45 | 0.20 |
| | None | 15 | 2.50 | 0.95 |
| 3B | S-1 | 125 | 2.25 | 0.10 |
| | None | 25 | 2.40 | 0.60 |
| 3C | S-1 | 155 | 1.80 | 0.07 |
| | None | 40 | 1.85 | 0.35 |
| 3D | S-2 | 125 | 1.95 | 0.10 |
| | None | 40 | 2.05 | 0.25 |

The above-described results show that the reversal light-sensitive materials of the present invention containing a desensitizer in the spontaneously developable silver halide grain layer provide improved reversal characteristics as compared with the control samples in that high sensitivity and low minimum density can be attained.

EXAMPLE 4

On a 125 $\mu$-thick, transparent cellulose acetate film support having as a backing layer a 8 $\mu$-thick gelatin layer containing a dispersion of a silicone oil and 2-(2-hydroxy-4-tert-butylphenyl)benzotriazole and containing triphenyl phosphate as a plasticizer were coated, in sequence, the following layers to prepare a light-sensitive sheet.

1. To 100 g of a dispersion containing 50 m mols of silver bromoiodide grains (iodide content: 2 mol%; mean grain size: 0.9 $\mu$) and 5.5 g of gelatin was added 2 ml of an aqueous solution containing 5 mg of sodium thiosulfate (anhydrous), and the emulsion was heat-treated at 70° C for 120 minutes under stirring. At 35° C, 3 ml of $\beta$-methoxyethyl alcohol containing 10 mg of Desensitizer S-7 was added thereto and, after stirring the emulsion for 30 minutes, a coupler dispersion containing 12 g of a diffusible yellow dye-providing coupler, $\alpha$-pivaloyl-$\alpha$-[3-(N-methyl-N-octadecylsulfamoyl)phenoxy]aceto-3,5-di-carboxyanilide, 14 ml of N,N-diethyllaurylamide and 12 g of gelatin was added thereto. After cool-setting, this mixture was cut into pieces and washed for 2 hours with cold water at about 10° C. To this was added 5 ml of an aqueous solution containing 200 mg of 1-hydroxy-3,5-dichloro-s-triazine sodium salt and the emulsion was coated in a dry thickness of 4.5 $\mu$.

2. An interlayer comprising 1.5 mg/100 cm$^2$ of 2,5-di-tert-octylhydroquinone, 3 mg/100 cm$^2$ of di-n-butyl phthalate and 13.5 mg/100 cm$^2$ of gelatin was coated.

3. A hot solution comprising 3.4 g of a development inhibitor-releasing coupler, $\alpha$-benzoyl-$\alpha$-(1-phenyl-5-tetrazolylthio)aceto-2-methoxy-5-tetradecyloxycarbonylanilide (Coupler DIR Y-3), 5 g of di-n-butyl phthalate and 8 cc of ethyl acetate was mixed with an aqueous solution containing 0.3 g of sodium $\alpha$-sulfo-bis(2-ethyl-hexyl)succinate, and the solution was subjected to vigorous mechanical stirring to obtain an emulsion. To this were added 100 g of a blue-sensitive high speed negative type silver bromoiodide emulsion (iodide content: 5.0 mol%; mean particle size: 1.1 $\mu$) containing 50 m mols of silver, and then 4 ml of a solution containing 40 mg of 4-hydroxy-6-methyl-1,3,3a,7-tetrazaindene and 5 ml of an aqueous solution containing 200 mg of 1-hydroxy-3,5-dichloro-s-triazine sodium salt, followed by coating the emulsion in a dry thickness of 3 $\mu$.

4. An interlayer containing 2 mg/100 cm$^2$ of Carey-Lea type yellow colloidal silver, 4 mg silver/100 cm$^2$ of an extremely low sensitive silver bromoiodide emulsion (iodide content: 25 mol%; mean grain size: 0.06 $\mu$), 2 g/100 cm$^2$ of 2,5-di-tert-octylhydroquinone and 13 mg/100 cm$^2$ of gelatin.

5. A magenta dye-providing layer containing a diffusible magenta dye-providing coupler, 1-(2,4,6-trichlorophenyl)-3-(3,5-dicarboxyanilino)-4-(3-octadecylcarbamoylphenylthio)-5-pyrazolone at a coverage of $5 \times 10^{-6}$ mol/100 cm$^2$, n-pentadecylhydroquinone at a coverage of 2 mg/100 cm$^2$, tri-n-hexyl phosphate at a coverage of 7 mg/100 cm$^2$, the same spontaneously developable silver halide grains as used for layer (1) at a coverage of $2 \times 10^{-5}$ mol/100 cm$^2$ of silver and gelatin at a coverage of 16 mg/100 cm$^2$.

6. A green-sensitive emulsion layer containing a development inhibitor-releasing coupler, 1-{4-[$\alpha$-(2,4-di-tert-amylphenoxy)butyramido]phenyl}-3-N-piperidino-4-(1-phenyl-5-tetrazolylthio)-5-pyrazolone at a coverage of $5 \times 10^{-6}$ mol/100 cm², 2,4-di-tert-amylphenol at a coverage of 2 mg/100 cm², tri-o-cresyl phosphate at a coverage of 1 mg/100 cm², and a green-sensitive high speed negative type silver bromoiodide emulsion (iodide content: 5.6 mol%; mean grain size: 0.9 $\mu$) at a coverage of $6 \times 10^{-5}$ mol/100 cm² of silver and at a coverage of 18 mg/100 cm² of gelatin sensitized with the following optical sensitizers;

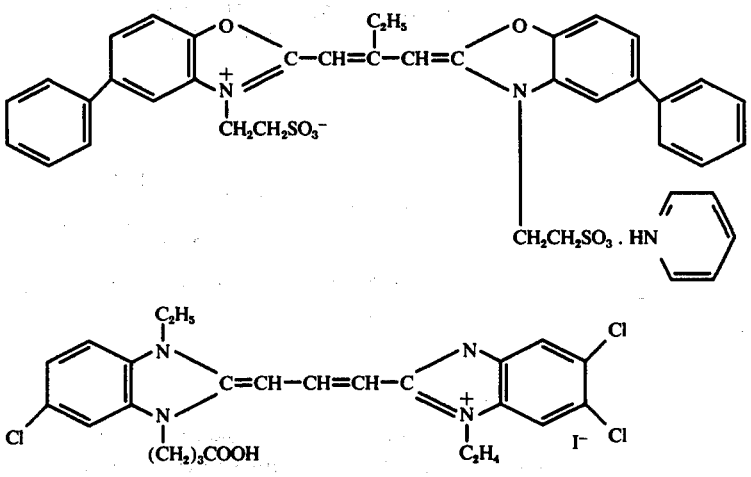

7. An interlayer containing an extremely low sensitive silver bromoiodide emulsion (iodide content: 25 mol%; mean grain size: 0.06 $\mu$) at a coverage of 2 mg/100 cm² of silver, 2,5-di-tert-octylhydroquinone at a coverage of 2 mg/100 cm² and gelatin at a coverage of 7 mg/100 cm².

8. A cyan dye-providing layer containing a diffusible cyan dye-providing coupler, 1-hydroxy-4-hexadecyloxy-N-ethyl-3',5'-dicarboxy-2-naphthanilide, at a coverage of $12.5 \times 10^{-6}$ mol/100 cm², n-pentadecylhydroquinone at a coverage of 1.5 mg/100 cm², N,N-diethyllauramide at a coverage of 3 mg/100 cm², the same spontaneously developable silver halide grains as used for layer (1) at a coverage of $6 \times 10^{-5}$ mol/100 cm² of silver and gelatin at a coverage of 20 mg/100 cm².

9. A red-sensitive emulsion layer containing a development inhibitor-releasing coupler, 1-hydroxy-4-(1-phenyl-5-tetrazolylthio)N-(2'-chloro-5'-tetradecyloxycarbonyl)-2-naphthanilide, at a coverage of $1 \times 10^{-5}$ mol/100 cm², N,N-diethyllaurylamide at a coverage of 6 mg/100 cm², a red-sensitive high speed negative type silver bromoiodide (iodide content: 5.6 mol%; mean grain size: 0.9 $\mu$) sensitized with the following optical sensitizers, at a coverage of $1 \times 10^{-4}$ mol/100 cm² of silver;

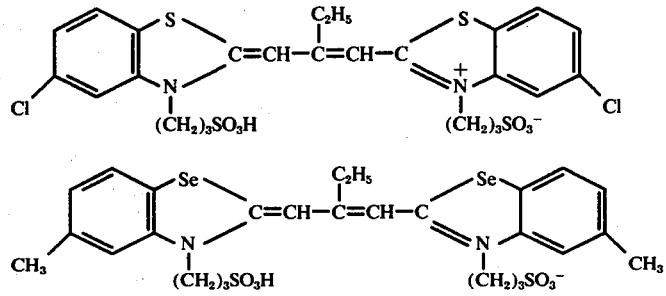

10. A light-intercepting layer containing 15 mg/100 cm² of carbon black and 35 mg/100 cm² of gelatin.

The thus prepared light-sensitive materials were subjected to blue light sensitometry, green light sensitometry and red light sensitometry, respectively, from the support side. Then, each of them was inserted into an envelope-shaped composite described in U.S. Pat. application Ser. No. 476,241, filed June 4, 1974, wherein an image-receiving sheet and a light-intercepting sheet were connected to each other at both edges, in such a manner that the light-sensitive layer came into face-to-face contact with the image-receiving layer, and the following processing solution was spread between the light-sensitive layer and the image-receiving layer in a spread thickness of 100 $\mu$.

The image-receiving layer was prepared as follows.

On a 125 $\mu$-thick cellulose acetate film having as a backing layer a 10 $\mu$-thick layer containing a 2-(2-hydroxy-4-tert-butylphenyl)benzotriazole colloidal dispersion and being plasticized with triphenyl phosphate and di(methoxyethyl) phthalate were coated, in sequence, the following layers to prepare an image-receiving sheet.

1. A neutralizing layer comprising a transparent film comprising 210 mg/100 cm² of 1:1 molar ratio copolymer of vinyl ethyl ether and maleic acid (completely hydrolyzed product of "Gantrez AN-139" made by GAF Co.) and 6 mg/100 cm² of 1,4-bis-(2,3-epoxypropoxy)butane.

2. A neutralization rate-controlling layer formed by coating a 60% hydrolyzed product of polyvinyl acetate in a dry thickness of 8 $\mu$.

3. An image-receiving layer comprising 25 mg/100 cm² of benzylcetyldiethylammonium bromide, 75 mg/100 cm² of gelatin and 2 mg/100 cm² of tetramethylol urea.

A rupturable container retaining 1.5 cm³ of a processing solution having the following formulation was prepared. This container was prepared by heat-sealing a laminate film of lead foil and a copolymer of vinyl chloride and vinyl acetate.

| | |
|---|---|
| Ascorbic Acid | 0.2 g |
| 3-Methyl-4-amino-N-ethyl-N-(β-hydroxyethyl)aniline sulfate | 30.0 g |
| Potassium Bromide | 1.4 g |
| Trisodium Phosphate (dodecahydrate) | 20.0 g |
| Sodium Hydroxide | 40.0 g |
| Hydroxyethyl Cellulose (highly viscous product) | 30.0 g |
| Water | 880.0 cc |

The light-intercepting sheet used in combination with the image-receiving layer was a 70 μ-thick cellulose acetate film containing 3% by weight of carbon black.

An image appeared on the image-receiving layer 1 minute after spreading the processing solution and, after about 5 minutes, the color image became well toned. Measurement of reflection density showed the following densities: blue light density: 1.9 (max) and 0.20 (min); green light density: 2.2 (max) and 0.18 (min); red light density: 2.3 (max) and 0.15 (min).

EXAMPLE 5

A light-sensitive sheet was completed using a development inhibitor-releasing hydroquinone, 2-(1-phenyl-5-tetrazolylthio)-3-octadecylhydroquinone (Coupler DIR H-3) at the coverage shown below in place of the DIR coupler contained in the third, sixth and ninth layers of the light-sensitive sheet described in Example 4. Similar results to those obtained in Example 4 were obtained.

| | |
|---|---|
| Third Layer | 9.5 mg/100 cm² |
| Sixth Layer | 6.0 mg/100 cm² |
| Ninth Layer | 10.2 mg/100 cm² |

EXAMPLE 6

On a 100 μ-thick polyethylene terephthalate film support were coated, in sequence, the following photographic layers to complete a direct reversal color photograhic material.

1. To 100 g of a dispersion containing 75 m mols of silver bromoiodide grains (iodide content: 2 mol%; mean grain size: 0.7 μ) and 6.5 g of gelatin was added 5 ml of an aqueous solution containing 10 mg of tetraethylenepentamine, and the dispersion was heat-treated at 65° C for 150 minutes under stirring to prepare a dispersion of spontaneously developable silver halide grains. To this was added an aqueous dispersion of a cyanforming coupler, 4,6-di-chloro-5-methyl-2-[α-(2,4-di-tert-amylphenoxy)butyramido]phenol (Coupler C-7) and di-n-butyl phthalate, and the dispersion was coated as a first layer. This layer was a non-diffusible cyan dye-forming layer containing spontaneously developable silver bromoiodide grains at a coverage of 11.8 mg/100 cm² of silver, the coupler at a coverage of $2.2 \times 10^{-5}$ mol/100 cm², di-n-butyl phthalate at a coverage of 9 mg/100 cm², n-pentadecylhydroquinone at a coverage of 2 mg/100 cm² and gelatin at a coverage of 31 mg/100 cm².

2. A red-sensitive emulsion layer containing a development inhibitor-releasing hydroquinone, 3-octadecylthio-5-phenylthio-6-(1-phenyl-5-tetrazolylthio)hydroquinone (Coupler DIR H-4) at a coverage of 10.2 mg/100 cm², N,N-diethyllaurylamide at a coverage of 4 mg/100 cm², gelatin at a coverage of 27 mg/100 cm² and a red-sensitve high speed negative type silver bromoiodide (iodide content: 5.6 mol%; mean grain size: 0.9 μ) sensitized with the following optical sensitizer, at a coverage of 10.0 mg/100 cm² of silver.

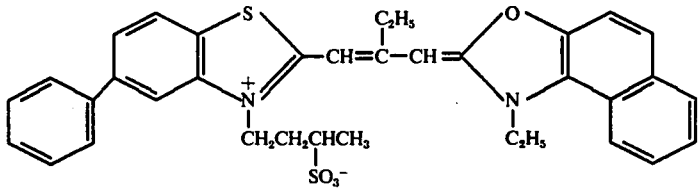

3. An interlayer containing 4 mg/100 cm² of an extremely low sensitve silver bromoiodide emulsion (iodide content: 25 mol%; mean grain size: 0.06 μ), 2 mg/100 cm² of 2,5-di-tert-octylhydroquinone, 2 mg/100 cm² of di-n-butyl phthalate and 13 mg/100 cm² of gelatin.

4. A non-diffusible magenta dye-forming layer containing a non-diffusible magenta dye-forming coupler, 1-(2,4,6-trichlorophenyl)-3-(3,5-dimethoxycarbonylanilino)-4-(3-octadecylcarbamoylphenylthio)-5-pyrazolone (Coupler M-13) at a coverage of $1.50 \times 10^{-5}$ mol/100 cm², tricresyl phosphate at a coverage of 7 mg/100 cm². 2,5-di-tert-octylhydroquinone at a coverage of 2 mg/100 cm², gelatin at a coverage of 40 mg/100 cm² and the same spontaneously developable silver bromoiodide dispersion as used in layer (1) at a coverage of 6.5 mg/100 cm² of silver.

5. A green-sensitive emulsion layer containing a development inhibitor-releasing hydroquinone, 3-octadecylthio-5-phenylthio-6-(1-phenyl-5-tetrazolylthio)hydroquinone (Coupler DIR H-4) at a coverage of 8.5 mg/100 cm², N,N-diethyllauramide at a coverage of 3.5 mg/100 cm², gelatin at a coverage of 24 mg/100 cm² and a green-sensitive high speed negative type silver bromoiodide (iodide content: 5.6 mol%; mean grain size: 0.9 μ) sensitized with the following sensitizer, at a coverage of 9.0 mg/100 cm² of silver.

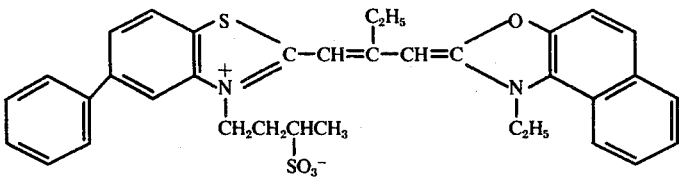

6. A yellow filter layer containing 2 mg/100 cm² of Carey-Lea type yellow colloidal silver, 4 mg silver/100 cm² of an extremely low sensitive silver bromoiodide emulsion (iodide content: 25 mol%; mean grain size: 0.06 μ), 2 mg/100 cm² of 2,5-di-tert-octylhydroquinone and 13 mg/100 cm² of gelatin.

7. To 100 g of the same spontaneously developable silver halide dispersion as used in layer (1) was added 5 ml of β-methoxyethanol containing 8.5 mg of Desensitizer S-1 and, after stirring for 30 minutes, the dispersion was mixed with a dispersion prepared by emulsifying a hot solution comprising 14.0 g of α-(4-methoxybenzoyl)-α-(5,5-dimethyl-3-hydantoinyl)aceto-2-chloro-5-[α-(2,4-di-tert-amylphenoxy)-butyramido]anilide (Coupler Y-9), 1.4 g of n-pentadecylhydroquinone, 4.0 g of di-n-butyl phthalate and 30 ml of ethyl acetate in 150 ml of a 50° C aqueous solution containing 10 g of gelatin and 0.7 g of sodium p-dodecylbenzenesulfonate. Then, the mixture was cooled to about 5° C to solidify, and then cut into pieces. After washing for 90 minutes in a 0.2% magnesium sulfate aqueous solution at about 10° C, 8 ml of a 3% methyl alcohol solution of triethylenephosphoramide was added thereto, followed by coating in a dry thickness of 3.7 μ. The thus formed non-diffusible yellow dye-forming layer contained $2.3 \times 10^{-5}$ mol/100 cm² of the coupler and 9.9 mg/100 cm² of silver.

8. A hot solution comprising 6.0 g of a development inhibitor-releasing hydroquinone, 3-octadecylthio-5-phenylthio-6-(1-phenyl-5-tetrazolylthio)hydroquinone (Coupler DIR H-4), 5.0 ml of di-n-butyl phthalate, 20 mg of sorbitan monolaurate and 20 ml of ethyl acetate was added to 90 ml of a 50° C aqueous solution containing 4.0 g of gelatin, 0.5 g of sodium p-dodecylbenzenesulfonate and 50 mg of sodium bisulfite and subjected to vigorous mechanical stirring to emulsify. To the resulting dispersion was added 100 g of a blue-sensitive negative type silver bromoiodide emulsion (iodide content: 5.0 mol%; mean grain size: 1.1 μ) containing 50 m mols of silver and 6 g of gelatin. Then, after adding thereto 4 ml of a solution containing 40 mg of 4-hydroxy-6-methyl-1,3,3a,7-tetrazaindene and 6 ml of a 3% methyl alcohol solution of triethylenephosphamide the resulting mixture was coated in a dry thickness of 3.6 μ to complete a blue-sensitive emulsion layer. This layer contained silver halide at a coverage of 10.0 mg/100 cm² of silver.

9. A protective layer comprising 13 mg/100 cm² of gelatin.

The thus prepared color photographic light-sensitive material was subjected to color sensitometry from the emulsion layer side, and processed as follows.

| Color Development Processing (25° C) | Time |
|---|---|
| 1. Color development | 2 min. |
| 2. Stop-Fixing | 2 min. |
| 3. Washing | 1 min. |
| 4. Bleaching | 4 min. |
| 5. Washing | 1 min. |

-continued

| | |
|---|---|
| 6. Fixing | 2 min. |
| 7. Washing | 5 min. |
| Color Developer Composition | |
| Sodium Sulfite (anhydrous | 15.0 g |
| 4-Amino-3-methyl-N-ethyl-N-β-hydroxyethylaniline Sulfate | 30.0 g |
| Trisodium Phosphate (dodecahydrate) | 50.0 g |
| Potassium Bromide | 1.4 g |
| Sodium Hydroxide | 8.0 g |
| Water to make | 1 liter |
| [pH: 12.2 at 25° C] | |

Stop-fixing and fixing were conducted using an aqueous solution buffered at pH 4.7 with acetic acid and sodium acetate and containing ammonium thiosulfate and sodium sulfite. Bleaching was effected in an almost neutral aqueous solution containing potassium ferricyanide and potassium bromide.

As a result of development processing, a good reversal color image having a blue light density of 2.35 (max) and 0.19 (min), a green light density of 2.5 (max) and 0.24 (min), and a red light density of 2.15 (max) and 0.15 (min), determined by measuring transmission density, was obtained.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material which comprises a support having thereon at least one emulsion layer unit comprising:

A. a hydrophilic colloid layer containing spontaneously developable silver halide grains which are associated with a color coupler capable of reacting with an oxidation product of an aromatic primary amino colour developing agent to provide a dye and which are rendered substantially light-insensitive with a desensitizing dye which is so strongly adsorbed on said spontaneously developable silver halide grains that it does not substantially migrate to a negative-type light sensitive silver halide emulsion layer adjacent thereto, and, B. an adjacent negative-type light-sensitive silver halide emulsion layer associated with a compound capable of reacting with an oxidation product of an aromatic primary amino color developer to release a diffusible development inhibitor.

2. The light-sensitive material as described in claim 1, wherein said desensitizer is a compound which acts on the spontaneously developable silver halide grains so as to substantially inhibit additional developability upon exposure without substantially affecting the spontaneous developability, and which is so strongly adsorbed and fixed onto said silver halide grains that the desensitizer does not substantially affect the light sensitivity of the adjacent light-sensitive emulsion layer.

3. The light-sensitive material as described in claim 1, wherein said desensitizing dye is an azine, a nitro compound, an azo dye, an anthraquinone dye, a triphenylmethane dye, a carbocyanine dye, a styryl dye or an anil dye.

4. The light-sensitive material as described in claim 1, wherein said desensitizing dye possesses at least one sulfo group, carboxy group or phosphoric acid group in the molecule.

5. The light-sensitive material as described in claim 1, wherein said desensitizing dye is a compound having a cathode polarographic halfwave potential more positive than about −1.0 volt.

6. The light-sensitive material as described in claim 1, wherein said desensitizing dye is selected from the compounds represented by the general formula (I)

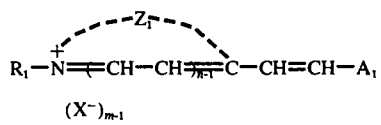

(I)

wherein $Z_1$ represents the atoms necessary for forming a heterocyclic ring, $R_1$ represents a saturated aliphatic group, $A_1$ represents a phenyl group having at least one nitro group, a naphthyl group, or a heterocyclic group, $m$ and $n$ each represents an integer of 1 or 2 and, when the compound forms a betaine structure, $m$=1, and X represents an anionic group, and $R_1$, $Z_1$ or $A_1$ contains at least one sulfo group, carboxy group or phosphoric acid group;

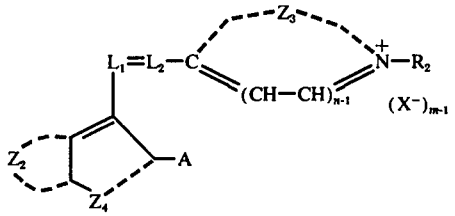

(II)

wherein $Z_2$ represents the atoms necessary for forming a cycloheptatriene ring, $Z_3$ represents the atoms necessary for forming a heterocyclic ring, $Z_4$ represents an oxygen atom, —NH— or —CH=, A represents a hydrogen atom, an oxygen atom (=0) or a halogen atom, $L_1$ and $L_2$ each represents a methine group, $R_2$ represents a saturated aliphatic group having at least one of a sulfo group, a carboxy group or a phosphoric acid group or an unsaturated aliphatic group, and X, $n$ and $m$ are the same as defined in general formula (I).

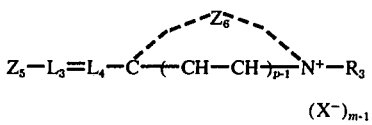

(III)

wherein $Z_5$ represents an indole nucleus, a carbazole nucleus or a phenothiazine nucleus, $Z_6$ is the same as $Z_3$ defined in general formula (II), $R_3$ represents a saturated or unsaturated aliphatic group, an unsaturated aliphatic group or an aryl group, $Z_5$, $Z_6$ or $R_3$ contains at least one sulfo group, carboxy group or phosphoric acid group, $L_3$ and $L_4$ each represents a methine group, P represents an integer of 1 or 2, and $X^-$ and $m$ are the same as defined in general formula (I);

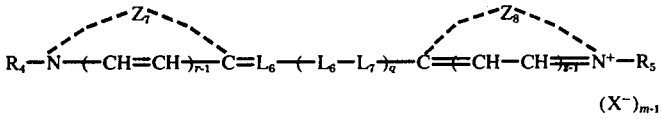

(IV)

wherein $Z_7$ and $Z_8$ each represents the atoms necessary for forming a 5- or 6-membered heterocyclic nucleus, at least one of $Z_7$ and $Z_8$ representing the atoms necessary for forming a 5- or 6-membered heterocyclic nucleus having an electron acceptive or desensitizing action, $R_4$ and $R_5$ are the same as defined with respect to $R_1$ in general formula (I), at least one of $R_4$ and $R_5$ containing a sulfo group, a carboxy group or a phosphoric acid group, $q$ represents an integer of 1, 2 or 3, $r$ and $s$ each repesents an integer of 1 or 2, $L_6$ and $L_7$ each represents a methine group, and $X^-$ and $m$ are the same as defined in general formula (I).

7. The light-sensitive material as described in claim 1, wherein said spontaneously developable silver halide grains comprise silver bromide, silver chlorobromide containing not more than about 20 mol% of chloride, silver bromoiodide containing not more than about 10 mol% of silver iodide, or silver chlorobromoiodide containing not more than about 20 mol% of chloride and not more than about 10 mol% silver iodide.

8. The light-sensitive material as described in claim 7, wherein the mean particle size of said spontaneously developable silver halide grains ranges from about 0.5$\mu$ to about 2$\mu$, and said spontaneously developable silver halide grains comprise not more than about 30%, based on the total amount of silver halide, of a particle size of not more than about 0.3$\mu$.

9. The light-sensitive material as described in claim 1, which contains silver halide grains rendered spontaneously developable by the action of a nucleus-forming agent.

10. The light-sensitve material as described in claim 9, said nucleus-forming agent is a silver nucleus-forming agent, a gold nucleus-forming agent or a silver sulfide nucleus-forming agent.

11. The light-sensitive material as described in claim 9, wherein of said spontaneously developable silver halide grains, about 20% to about 80% are rendered spontaneously developable under the developing conditions applied to the light-sensitive material due to the action of the nucleus-forming agent.

12. The light-sensitive material as described in claim 1, wherein said coupler associated with the spontaneously developable silver halide grains is a ballasted compound capable of reacting with an oxidation product of an aromatic primary amino color developing agent to provide a diffusible dye having a selective absorption in substantially the same wavelength region as the light-sensitive region of the light-sensitive emulsion layer.

13. The light-sensitive material as described in claim 12, wherein said light-sensitive silver halide emulsion layer provides, when processed with an aromatic primary amino color developing agent, a development inhibitor and a non-diffusible dye having a selective absorption in substantially the same wavelength region as the light-sensitive wavelength region of the emulsion layer.

14. The light-sensitive material as described in claim 1, wherein said coupler associated with the spontaneously developable silver halide grains is a ballasted compound capable of reacting with an oxidation product of an aromatic primary amino color developing agent to provide a non-diffusible dye having a selective absorption in substantially the same wavelength region as the light-sensitive region of the light-sensitive emulsion layer.

15. The light-sensitive material as described in claim 12, wherein said light-sensitive silver halide emulsion is associated with a compound capable of reacting with an oxidation product of an aromatic primar amino color developing agent to provide both a diffusible development inhibitor and a substantially colorless product.

16. The light-sensitive materal as described in claim 1, wherein said development inhibitor-releasing compound is a coupler capable of reacting with an oxidation product of a color developing agent to provide a diffusible development inhibitor and a nondiffusible dye.

17. The light-sensitive material as described in claim 15, wherein said development inhibitor-releasing coupler is a ballasted coupler whose coupling reaction site is substituted with a development inhibitor residue.

18. The light-sensitive material as described in claim 17, wherein the development inhibitor residue is an arylthio group, a heterocyclic ring thio group, and a benzotriazolyl group, and the coupler contains a phenol group, a naphthol group, a 5-pyrazolone group or an open-chain ketomethylene group as a coupling structure moiety.

19. The light-sensitive material as described in claim 1, wherein said development inhibitor-releasing compound is a hydroquinone derivative which is nucleus-substituted with an arylthio group or a heterocyclic ring thio group.

20. The light-sensitive material as described in claim 1, including an interlayer comprising a silver halide-free hydrophilic colloid separating said layer containing said spontaneously developable silver halide grains and said light-sensitive emulsion layer associated with the development inhibitor-releasing compound.

21. The light-sensitive mateial as described in claim 20, wherein said interlayer contains a compound capable of reacting with an oxidation product of an aromatic primary amino color developing agent to provide a photographically inert product.

22. The light-sensitive material as described in claim 20, wherein said interlayer contains a hydroquinone derivative ballasted by a ballasting group having 8 or more carbon atoms.

23. The color photographic light-sensitive material as described in claim 1, wherein one of said at least one emulsion layer unit is a blue-sensitive layer unit comprising:

A. a hydrophilic colloid layer containing a yellow dye-forming coupler capable of reacting with an oxidation product of an aromatic primary amino color developing agent to form a yellow dye and spontaneously developable silver halide grains which are rendered substantially light-insensitive with a desensitizing dye, and B. an adjacent negative-type blue-sensitive silver halide emulsion layer containing a compound capable of reacting with an oxidation product of an aromatic primary amino color developing agent to release a diffusible development inhibitor.

24. The photographic light-sensitive material as claimed in claim 1 wherein said material contains at least two emulsion layer units and wherein a hydrophilic colloid layer containing a compound capable of trapping a released development inhibitor is located between said units.

25. The light-sensitive material as described in claim 24, wherein said hydrophilic colloid layer between the emulsion layer units contains low sensitive silver halide having a fine particle size and/or Carey-Lea type colloidal silver.

26. A diffusion transfer color photographic film unit, which contains:

I. a light-sensitive element comprising a support having thereon at least one emulsion layer unit comprising A. a hydrophilic layer which is associated with a ballasted color coupler capable of reacting with an oxidation product of an aromatic primary amino color developing agent to provide a diffusible dye and which contains spontaneously developable silver halide grains which are rendered substantially light-insensitive with a desensitizing dye which is so strongly adsorbed on said spontaneously developable silver halide grains that it does not substantially migrate to a negative-type light-sensitive silver halide emulsion layer adjacent thereto, and B. a negative-type light-sensitive silver halide emulsion layer which is adjacent layer (A) and which is associated with a compound capable of reacting with an oxidation product of an aromatic primary amino color developing agent to release a diffusible development inhibitor, II. an image-receiving element which receives diffusible dyes formed on development of the silver halide of said light-sensitive element (I) as a transferred image, and III. a repturable processing solution container retaining an alkaline processing solution for development of said silver halide of said light-sensitive element (I) and containing said aromatic primary amino color developing agent.

* * * * *